United States Patent [19]

Burt, Jr. et al.

[11] 4,044,641

[45] Aug. 30, 1977

[54] MACHINE FOR HANDLING SHEET MATERIAL

[75] Inventors: George A. Burt, Jr.; William M. Neill, both of Santa Clara, Calif.

[73] Assignee: International Paper Company, New York, N.Y.

[21] Appl. No.: 725,328

[22] Filed: Sept. 21, 1976

Related U.S. Application Data

[60] Continuation of Ser. No. 546,602, Feb. 3, 1975, abandoned, which is a division of Ser. No. 388,813, Aug. 16, 1973, Pat. No. 3,888,395.

[51] Int. Cl.[2] ..... B26D 1/56

[52] U.S. Cl. ..... 83/341; 83/343; 83/346

[58] Field of Search ..... 83/341, 342, 336, 331, 83/333, 339, 343, 344, 346

[56] References Cited

U.S. PATENT DOCUMENTS

| | | | |
|---|---|---|---|
| 2,568,333 | 9/1951 | Henschker et al. | 83/341 |
| 3,203,292 | 8/1965 | Schmermund | 83/341 |
| 3,552,251 | 1/1971 | Neff | 83/342 |

*Primary Examiner*—Donald R. Schran

*Attorney, Agent, or Firm*—James F. Haley, Jr.

[57] ABSTRACT

A machine for automatically producing a bib apron and for affixing a narrow strip thereto to form both the neck loop and tie elements for the apron. The machine includes a cutting mechanism having a skewed roller carrying a cutting blade which makes point contact with a second roller to divide a continuous web of non-woven fibrous material into separate rectangular sheets. The material for the strip is folded longitudinally and is then advanced across each sheet by a feed mechanism including a capstan drive and a clamping mechanism for holding the strip in juxtaposition with the sheet. Thereafter, the strip is contacted by a pull member which draws the center of the strip in a downstream direction to form a "V". The forward corners of the sheet are then folded over the legs of the V and are adhesively secured to the body of the sheet to hold the strip in place. Upon the actuation of the clamping mechanism to sever the strip from its supply, the thus completed apron is advanced past three additional folding stations. The apron is folded longitudinally at the first of two of these stations and transversely at the third station to facilitate stacking and packaging.

7 Claims, 47 Drawing Figures

50
51
52
53
54
55
56
57
65
756
758
760
755
772
169
390
770
325
765
335
775

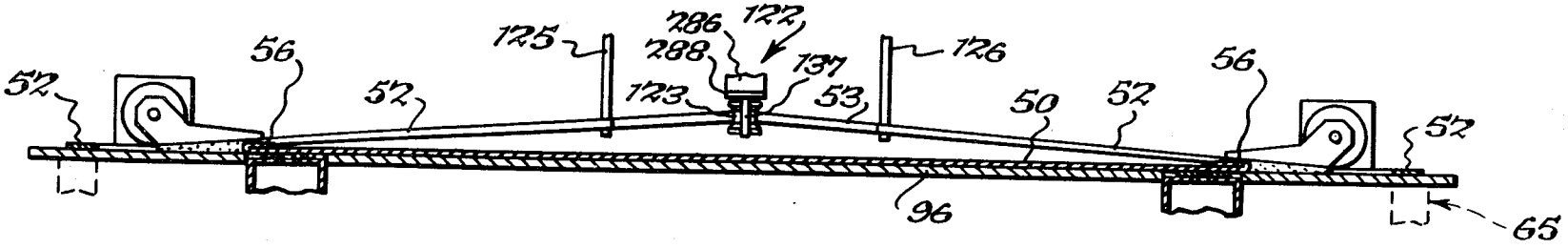
Fig. 35.
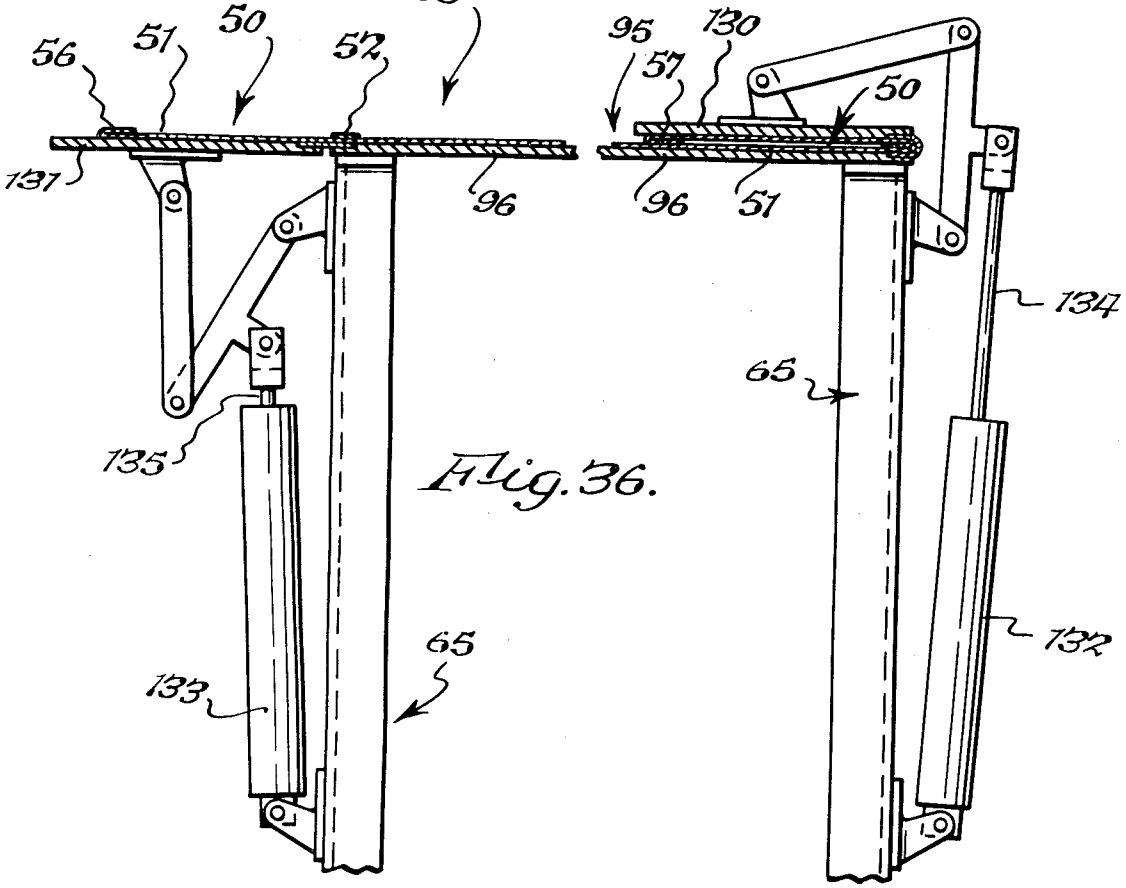
Fig. 37.
Fig. 36.

302
301
300
S1
317
195
S2
320
S3
S4
325
S5
RC
83
TDA
RB
704
RA
RB1
305
RA1
308
RA2
RA3
TDA1
311
309
RB2
223
220
TEST
315
231
RESET
STRIP PHOTO-CELL
313
312
328
211
212
RE
START
STOP
RC1
222
332
RD1
RD
329
335
RE1
337
338
RE2
RF
RM4
RP
360
TDE1
RL
355
RL1
TDE
TDE1
RM1
RP1
RM
1
2
3
4
5
6
7
8
9
10
11
12
13
14
15
16
17
18
19
20
21
22
23
24
25
26

300
301
RF2
RG2
RG
TDF
382
RF1
RL2
340
RM2
372
RG1
374
359
385
RL3
386
384
RK
356
RK1
198
RK2
370
376
RN1
RN
RM3
RN2
RO
RO1
378
RO2
380
357
RH
TDC
RF3
RH1
TDD
TDC1
RJ
TDD1
RI
365
RJ1
368
RH2
RI1
367
RF4
366
TDB1
TDG
TDB
TDB2
TDG1
388
PRE. COUNTER
395
396
RK3
RQ2
RQ
RH3
RQ3
RJ2
RQ1
397
TOTAL COUNT
RK4
399
27
28
29
30
31
32
33
34
35
36
37
38
39
40
41
42
43
44
45
46
47
48
49
49a

MACHINE FOR HANDLING SHEET MATERIAL

This is a continuation of application Ser. No. 546,602, filed Feb. 3, 1975, now abandoned, which is a division of application Ser. No. 388,813, filed Aug. 16, 1973, now U.S. Pat. No. 3,888,395.

BACKGROUND OF THE INVENTION

This invention relates to a machine for handling sheet material and more particularly to a machine for dividing a web of material into successive sheets and for affixing a narrow strip to each sheet to produce a garment.

There has been developed a bib apron and a method for making the same which is extremely economical and high satisfactory in use. A representative apron of this type is disclosed in copending U.S. patent application Ser. No. 322,723 filed Jan. 11, 1973 by Richard A. Batt, and a particularly advantageous method for producing the apron is disclosed in copending U.S. patent application Ser. No. 322,722 also filed Jan. 11, 1973 by Richard A. Batt and Charles B. Green. The aprons customarily are fabricated from a continuous web of nonwoven material which is provided with side seams along its longitudinal edges and is cut in a transverse direction to form successive sheets. A narrow nonwoven strip is positioned across each sheet and is uniquely oriented such that when two of the opposed corners of the sheet are folded over portions of the strip and are attached to the body of the sheet, the strip is firmly held in place to form both the neck loop and the tie elements for the apron.

To manufacture aprons and other garments of the foregoing type, it was heretofore often necessary to produce the garments on a piecework basis, with at least some of the cutting, folding, fastening and transporting operations being performed in a more or less manual fashion. The remaining operations for the most part necessitated the use of quite complicated machinery which was difficult and expensive to obtain and was occasionally unreliable in use. In addition, and this has been of special moment in the manufacture of garments of the bib apron type, problems arose heretofore in the assembly and fastening of the neck loops and tie elements to the main body portions of the garments.

Still further difficulties were encountered, in attempting to design automated machinery for this purpose, because of the need for maintaining a satisfactory production rate while keeping the mechanical loading of the machine within reasonable limits. These latter difficulties were of particular concern in the design of the mechanism for severing the web of material to form the successive sheets. Also, problems were encountered heretofore in uniformly and smoothly advancing precise lengths of the narrow strip material to a predetermined location on the machine and then severing the strip at the appropriate point in the operation cycle.

SUMMARY

One general object of this invention, therefore, is to provide a new and improved machine for dividing a web of material into successive sheets and for affixing a narrow strip to each sheet to produce a garment.

More specifically, it is an object of this invention to provide such a machine for automatically manufacturing bib aprons and similar garments on a mass production basis.

Another object of this invention is to provide a machine of the character indicated which includes a novel cutting mechanism for separating a continuous web of material into individual sheets.

A further object of this invention is to provide a garment making machine which automatically advances a narrow strip to a series of intermittently moving sheets in timed relationship with the movement of the sheets.

Still another object of the invention is to provide a machine of the foregoing type which includes a unique mechanism for clamping the strip and then cutting it at the appropriate points in the operation cycle.

A still further object of this invention is to provide an apron making machine utilizing comparatively simple mechanical and electrical components which is economical to manufacture and thoroughly reliable in operation.

In one illustrative embodiment of the invention, a continuous web of flexible sheet material is received from a suitable source and is directed along a feed path. Beads of adhesive are applied along the longitudinal edges of the web, and a pair of folding devices are effective to form narrow edge folds and thereby produce side hems. As the web proceeds along its path, it moves past a cutting mechanism which divides the web into successive rectangular sheets.

Following the formation of a given sheet from the web, a narrow strip of material is led across the fed path on the downstream side of the cutting mechanism and is located in a precise position across the sheet. A pull member engages the strip intermediate its ends and is advanced in a longitudinal direction such that the strip forms a V. The sheet is maintained stationary at this point at a first folding station. The forward corners of the sheet are folded over the two legs of the V and are adhesively secured to the remaining portion of the sheet to complete the garment.

The thus completed garment continues its advance along the feed path to three succeeding folding stations. A plurality of longitudinal folds are produced in the garment at the first station, a single longitudinal fold is produced at the second station and a single transverse fold at the third station. The garment is thus reduced to a size which facilitates stacking and packaging.

In accordance with one feature of the invention, in certain particularly advantageous embodiments, the cutting mechanism for separating the web into individual sheets comprises a pair of cooperating rollers which are skewed relative to one another. A cutting blade on one of the rollers severs the web in the transverse direction and yet makes contact with the other roller at only a single point at any one time. With this arrangement, the wab is rapidly and accurately cut into successive sheets while holding the mechanical loading of the mechanism within reasonable limits.

In accordance with another feature of the invention, in several important embodiments, the strip advancing unit includes a capstan drive in engagement with only a single side of the strip for applying driving force thereto. The capstan facilitates the advance of the strip from a suitable supply roll toward its position across the incoming sheets.

In accordance with still another feature of the invention, in some embodiments, the free end of the strip is advanced across the machine and is held stationary by a novel clamping unit. At succeeding points in the operation cycle the clamping unit releases the strip; moves back across the machine to its initial position and then neatly and cleanly severs the strip.

The present invention, as well as further objects and features thereof, will be understood more clearly and fully from the following description of a preferred embodiment, when read with reference to the accompanying drawings.

BRIEF DESCRIPTION OF THE DRAWINGS

FIG. 35 is an enlarged transverse sectional view taken along the line 35—35 in FIG. 2B, with certain parts omitted for purposes of clarity.

FIG. 36 is a fragmentary sectional view taken along the line 36—36 in FIG. 2B.

FIG. 37 is a fragmentary sectional view taken along the line 37—37 in FIG. 2B but with certain components in a different position.

DESCRIPTION OF A PREFERRED EMBODIMENT

Figures 2C, 7, 8, 9, 10:
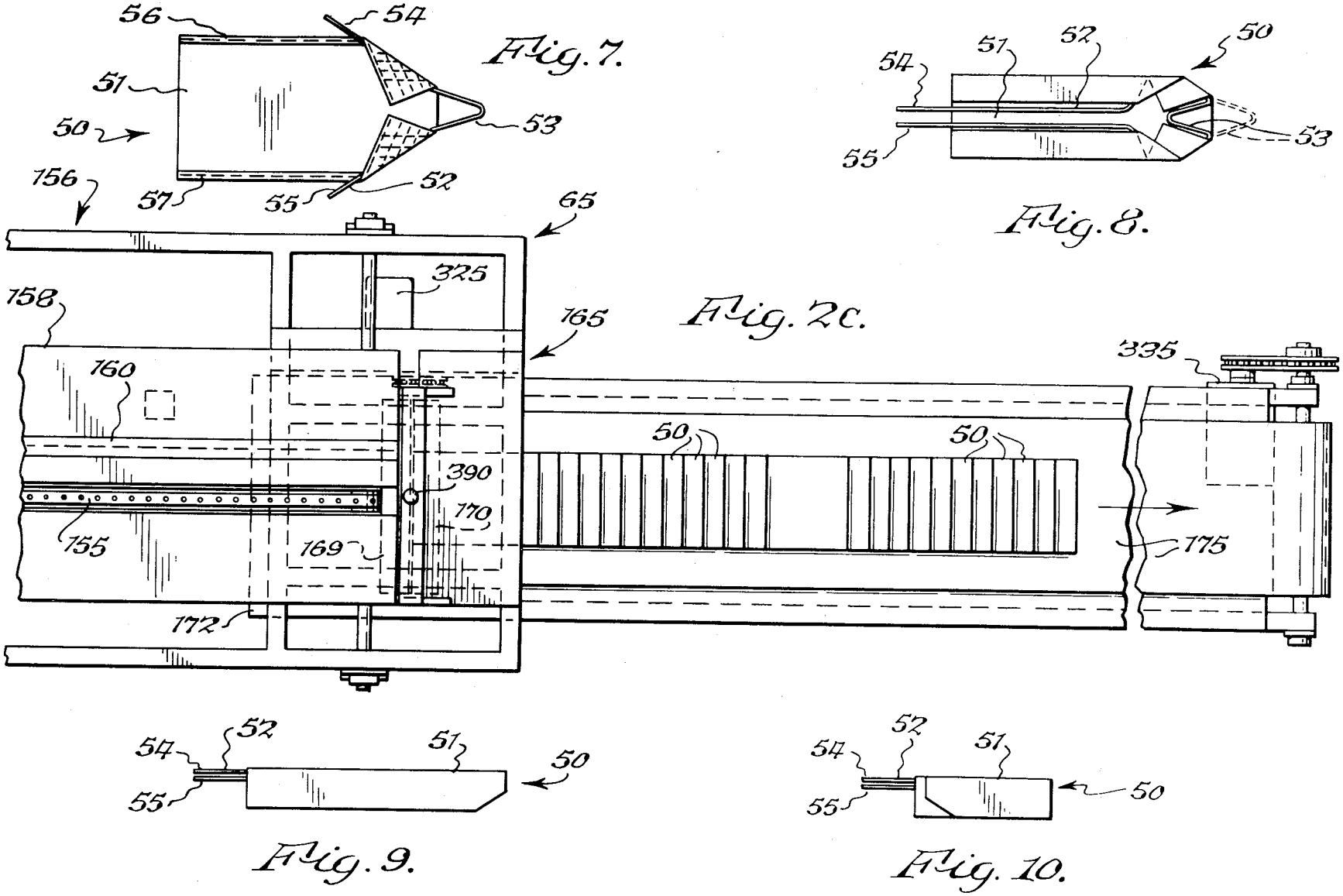

Referring to the drawings, there is shown a machine for manufacturing bib aprons such as the aprons 50 illustrated in FIG. 7. Each of the aprons 50 includes a main body portion formed from a rectangular sheet 51 and a single cord or strip 52. In the illustrated embodiment the sheet 51 and the strip 52 advantageously are of nonwoven fibrous material, although in other arrangements various woven fabrics or nonporous materials such as polyethylene, rubber, etc., may be employed. The strip 52 forms both a neck loop 53 and tie elements 54 and 55 for the apron and is of a length sufficient to enable the tie elements to be secured either behind or in front of the wearer. The longitudinal edges of the sheet 51 are folded over the main body portion of the sheet and are adhesively held in place to provide side hems 56 and 57. Following the manufacture of the apron, the machine folds it longitudinally and transversely in the manner illustrated in FIGS. 8—10 for stacking and packaging.

In order to facilitate the detailed description of the machine illustrated in the drawings, there will first be given a discussion of the general mode of operation of the machine. That is before describing the construction and arrangement of various parts of the machine, a description will be given of its overall function in producing the successive sheets 51 and applying the strips 52 thereto to form the aprons 50.

GENERAL OPERATION

The sheets 51 are fabricated from a continuous nonwoven web 60 which is stored in roll form on an unwind stand 61 or other suitable source. The web 10 is drawn from the stand 61 over a receiving table 62 by a pair of drive rollers 63 and 64. The table 62 forms a part of the machine frame 65, and this frame defines a longitudinally extending feed path for the web material along which the various manufacturing operations are performed.

As the web 60 moves onto the table 62, it passes over an idler roller 67, then around a dancer arm roller 68 and then over a second idler roller 69. The rollers 67 and 69 are suitably supported by the table 62, while the roller 68 is carried at the free end of a dancer arm 70. The opposite end of the arm 70 is pivotally mounted on the unwind stand 61 such that the arm is free to swing in an upward direction from the position illustrated in FIG. 1A. The arm 70 and the associated rollers 67, 68 and 69 operate as a storage device to store a predetermined length of the web 60 along the feed path. The stored length preferably is at least equal to the length of each apron to be produced.

Figure 2A:
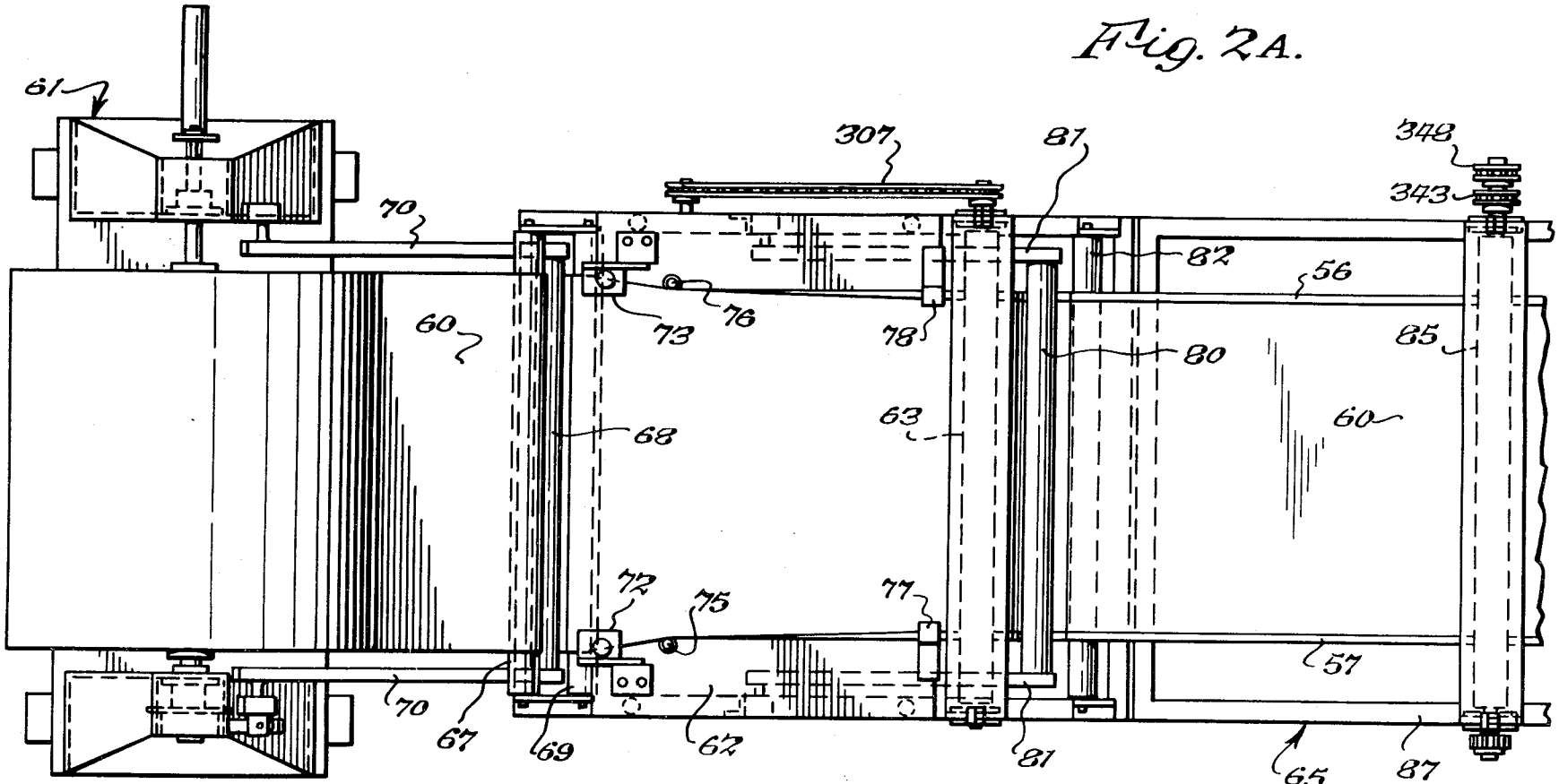
FIGS. 2A, 2B and 2C collectively comprise an enlarged top plan view of the machine shown in FIG. 1.
Figure 3:
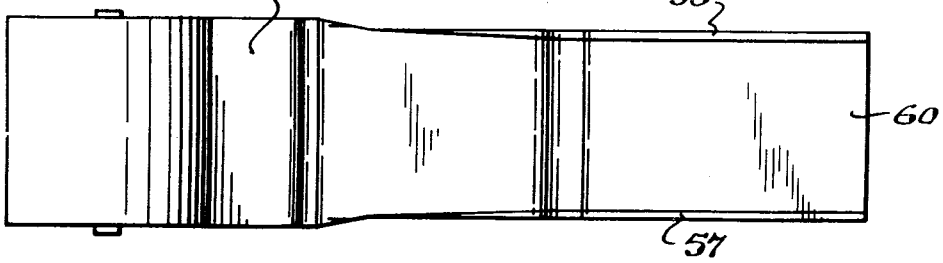
FIGS. 3 through 10 are successive top plan views of the apron material as it is processed by the machine.

The table 62 serves as a side hemming station for the web 60. As the web moves upwardly from the dancer arm roller 68 and over the roller 69, it passes beneath a pair of spaced adhesive units 72 and 73 (FIG. 2A). The units 72 and 73 are respectively disposed a short distance above the longitudinal edges of the web 60 and are arranged to apply beads of adhesive thereto as the web continues its movement. The adhesive preferably is heated in order to reduce its viscosity and thus increase the flowability of the adhesive onto the web, and in some cases a suitable heat lamp (not shown) is employed to maintain the adhesive at an elevated temperature after its application. The longitudinal edges of the web are then turned in an upward direction as the web moves past two stationary posts 75 and 76, and shortly before the web reaches the downstream end of the table 62 a pair of folding devices 77 and 78 turn over the upstanding edges to form a narrow fold along each edge. Immediately thereafter, the web passes between the drive rollers 63 and 64 to crease the thus formed folds. The folds are adhesively secured to the main body portion of the web to produce the side hems 56 and 57.

Upon emerging from between the drive rollers 63 and 64, the web 60 is led through a second storage device including a roller 80 carried by a dancer arm 81. The dancer arm 81 is pivotally supported by the frame for the table 62 and is movable in an upward direction from the position shown in FIG. 1A in response to movement of the web 60 along the feed path. After passing around the roller 80, the web proceeds over an idler roller 82. With the dancer arm 81 in its lowermost position (the position shown), indicating maximum web storage, the arm actuates a limit switch 83 to stop the drive rollers 63 and 64 in a manner that will become more fully apparent hereinafter.

The web 60 proceeds from the idler roller 82 to a second pair of drive rollers 85 and 86 disposed along the feed path. The rollers 85 and 86 are supported by a table 87 and serve to advance the web through a cutting mechanism 90 including a pair of opposed cutting rollers 91 and 92 on the downstream side of the drive rollers. A knife or blade 93 on the roller 91 makes point contact with the roller 92 and is arranged to cut the web along a straight line which extends in a direction transverse to the web's direction of movement along its feed path, thus forming the successive sheets 51.

As each of the sheets 51 leaves the cutting mechanism 90, it moves toward a first folding station indicated generally at 95. The folding station 95 includes a sheet supporting table 96 and two vacuum belts 97 and 98 (FIG. 2B) which serve to hold the sheet 51 flat while advancing it into position. During the movement of the sheet toward the folding station, it passes beneath spaced groups 100 and 101 of stationary adhesive units. The adhesive units are arranged to form corresponding groups 102 and 103 (FIG. 4) of bond lines on the sheet adjacent the forward opposed corners thereof. These bond lines extend in directions parallel to the direction of movement of the sheet along its feed path and are laid down as the leading edge of the sheet moves beneath the units 100 and 101 and proceeds for a distance of about one foot along the path. In the illustrated embodiment there are five lines in each of the groups 102 and 103 with approximately 2 inches between adjacent lines. Each of the lines illustratively is 10 inches long with the exception of the outside lines which are 12 inches.

Figure 1A:
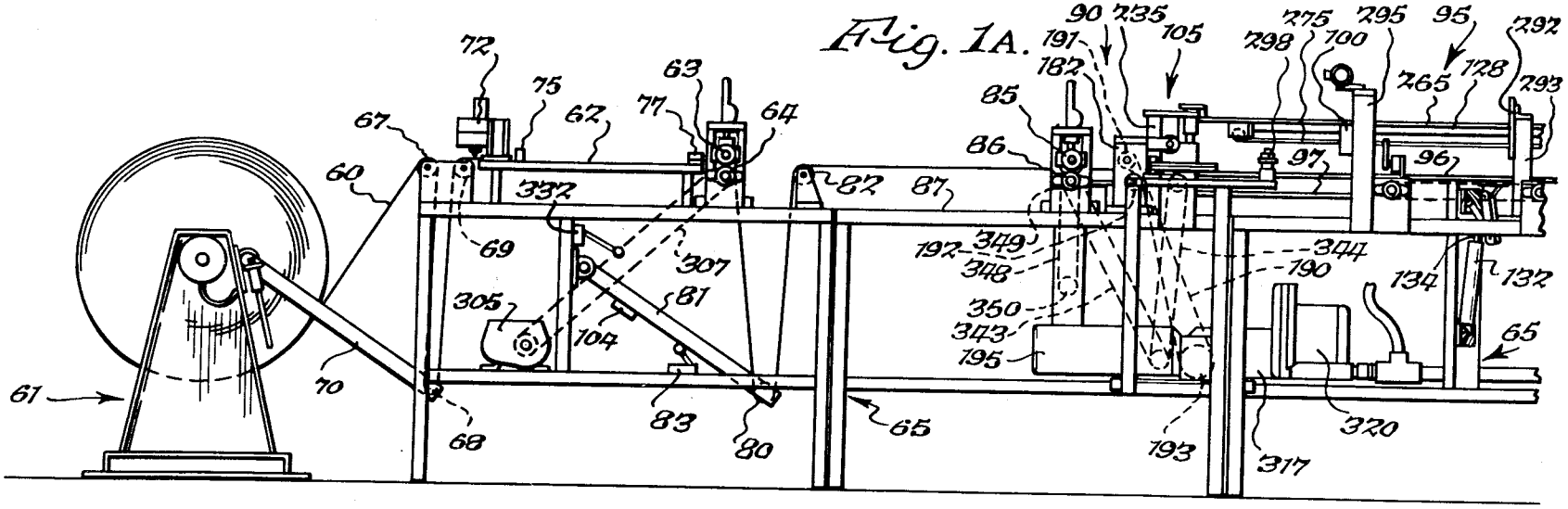
FIGS. 1A and 1B collectively comprise a side elevational view of a machine for manufacturing bib aprons in accordance with an illustrative embodiment of the invention, with portions of the strip unit of the machine omitted for purposes of clarity.

The vacuum belts 97 and 98 are mechanically linked to the drive rollers 85 and 86 (FIG. 1A). When the rollers 85 and 86 have advanced a sufficient quantity of web material through the cutting mechanism 90 to the folding station 95 to the drive rollers and the vacuum belts are shut down to bring the sheet to rest at the folding station.

Figures 11, 12, 13, 14, 15:
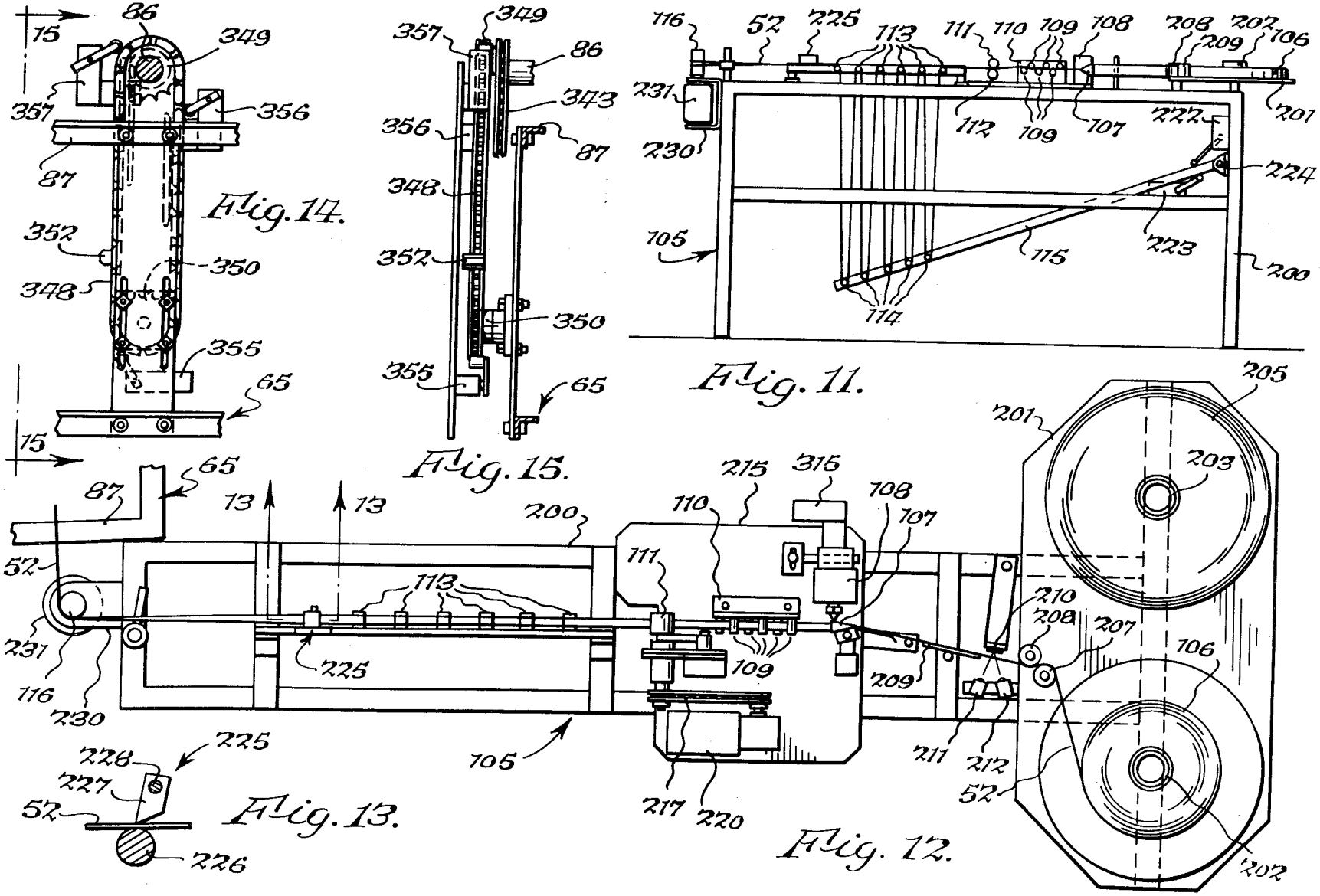
FIG. 11 is a side elevational view of the strip feeding mechanism of the machine.
FIG. 12 is an enlarged top plan view of the mechanism shown in FIG. 11, together with a portion of the machine frame.
FIG. 13 is a fragmentary sectional view taken along the line 13—13 in FIG. 12.
FIG. 14 is an enlarged sectional view taken along the line 14—14 in FIG. 2B and illustrating a timing chain for the sequential indexing of the machine.
FIG. 15 is a side elevational view taken along the line 15—15 in FIG. 14.

During the time each of the sheets 51 is being indexed into position at the folding station 95, a strip mechanism 105 is effective to draw strip material across the feed path on the downstream side of the cutting mechanism 90 and to position a strip 52 in spaced juxtaposition with the sheet at the folding station. As best shown in FIGS. 11 and 12, the material for the strip is unwound from a supply reel 106. The material moves from the reel 106 through a folding device 107 and then past an adhesive dispensing unit 108 in a direction opposite to the direction of the sheet 51 and in parallel relationship therewith. The device 107 produces an open median fold of V-shaped cross-section in the strip, and the unit 108 thereupon inserts adhesive into the fold. The strip proceeds around a group of idler rollers 109 in a storage assembly 110 to crease the fold and provide sufficient time to set the adhesive.

The thus folded strip 52 proceeds through a pair of drive rollers 111 and 112 and then alternately around spaced idler rollers 113 and corresponding dancer arm rollers 114. The rollers 114 are carried on a pivotally supported dancer arm 115 and cooperate with the rollers 113 to store a substantial length of the strip material. The length of the stored material should be at least equal to that of the strip for each of the aprons 50.

Figures 2B, 4, 5, 6:
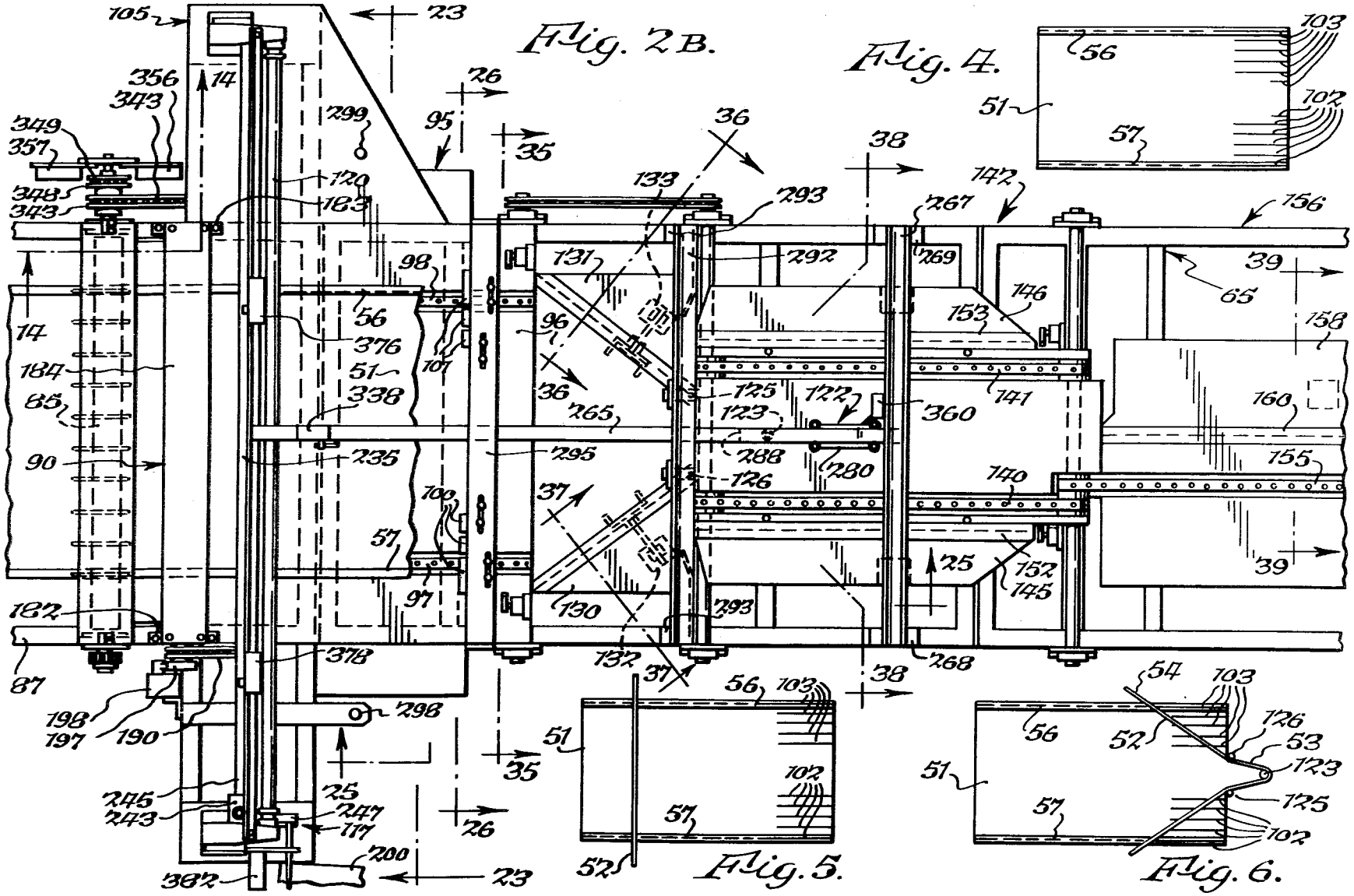

From the dancer arm 115 and the last idler roller 113 the path of the strip material extends around an upstanding capstan 116. The capstan 116 engages a single side of the strip and is independently driven to apply driving force to the strip as it changes direction and approaches the feed path of the sheet 51. At a particular point in the operation cycle, the free end of the strip is firmly gripped by a clamping mechanism 117 when in the position illustrated by full lines in FIGS. 23 and 24. The mechanism 117 cooperates with a piston 119 within a cable cylinder 120 which extends transversely over the sheet feed path a short distance downstream of the point at which the sheet 51 emerges from the cutting mechanism 90. In response to the movement of the piston 119 from the position shown in FIG. 23, the mechanism 90 is carried across the machine to the position illustrated in dash lines. In this latter position the strip 52 is disposed in a predetermined location above the incoming sheet 51 as illustrated in FIG. 5.

As the sheet 51 indexes into position at the folding station 95 (FIG. 2B), a neck pull mechanism 122 draws the neck loop portion 53 of the strip 52 in a downstream direction to produce a V configuration. The mechanism 122 includes a depending roller 123 (FIGS. 6 and 25) which is longitudinally reciprocable along the center line of the sheet feed path between two stationary posts 125 and 126. The movement of the roller 123 is controlled by a cable cylinder 128. This cylinder is centrally located a short distance above the feed path and extends over the folding station 95 from a position adjacent the strip mechanism 105. Upon the downstream movement of the roller 123 in response to actuation of the cylinder 128, the roller engages the center of the strip and draws it between the posts 125 and 126. The strip comes to rest with the two legs of the V in respective juxtaposition with the spaced groups 102 and 103 of adhesive lines on the sheet 51.

With the strip 52 in position above the sheet 51 at the folding station 95, two triangular folding plates 130 and 131 (FIG. 2B) are actuated to fold the opposed corners of the sheet over the legs of the strip and into contact with the adhesive groups 102 and 103. The plates 130 and 131 are hinged to the table 96 and move in unison from a position substantially coplanar therewith (the position shown in FIG. 36) to a position in which the plates overlie the sheet as illustrated in FIG. 37. The plates 130 and 131 are controlled by respective pneumatic cylinders 132 and 133. Upon the operation of these cylinders, their corresponding piston rods 134 and 135 move in an upward direction to swing the plates over the table 96 and adhesively secure the legs of the V-shaped strip and the opposed corners of the sheet 51 to the main body portion of the sheet.

During the time the folding plates 130 and 131 are pressed against the sheet 51 at the folding station 95, the free end of the strip 52 is released by the clamping mechanism 117. The cable cylinder 120 returns the mechanism 117 across the feed path to its initial position, that is, the position shown in full lines in FIGS. 23 and 24, and the mechanism is actuated to sever the strip 52 from its supply and to firmly clamp the free end of the strip material in preparation for the succeeding sheet. The neck pull mechanism 122 also is returned to move the roller 123 back to the position shown in full lines in FIG. 25 preparatory to the receipt of the succeeding strip. As the roller 123 leaves its downstream position (the dotted line position), a depending finger 137 engages the neck loop 53 on the strip 52 to carry the neck loop back over the sheet 51 from the position shown in FIG. 7 to that shown in FIG. 8 and to deposit it on the leading portion of the sheet. The pneumatic cylinders 132 and 133 (FIGS. 36 and 37) thereupon return the folding plates 130 and 131 to release the sheet.

In response to the return of the folding plates 130 and 131, the vacuum belts 97 and 98 (FIG. 2B) again begin to advance the sheet 51, which is now in the form of the completed apron 50, along the feed path. The apron 50 proceeds onto two additional vacuum belts 140 and 141 which carry the apron to a second folding station 142, and the movement of the belts is then arrested to maintain the apron in position at the second station. During the apron's advance, a succeeding sheet 51 moves into position at the first folding station 95.

Figure 38:
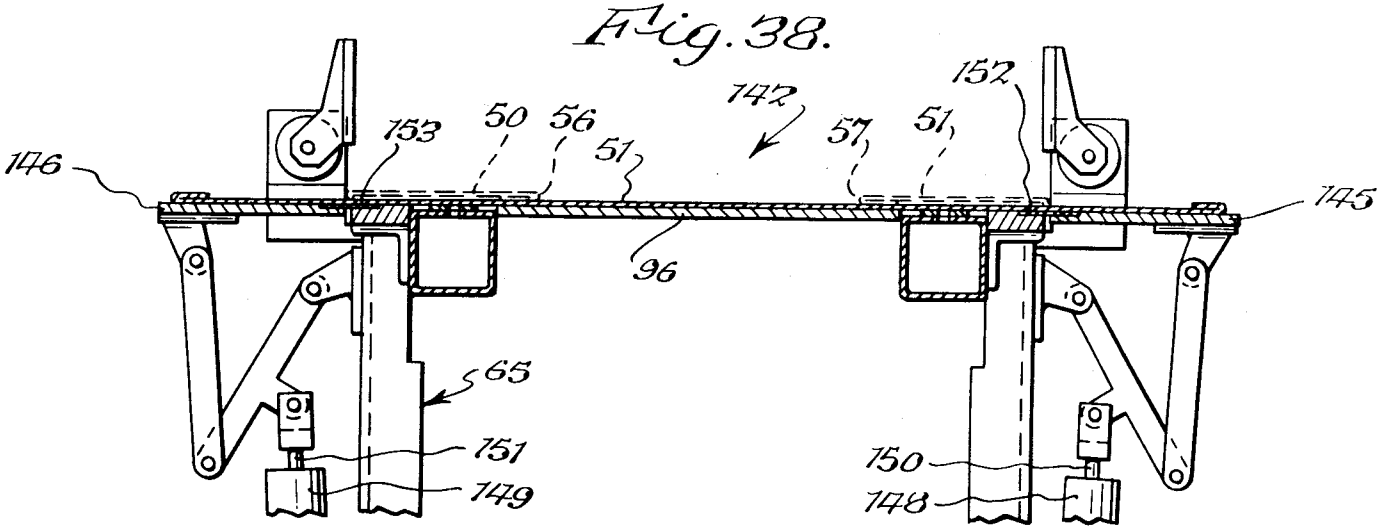
FIG. 38 is an enlarged transverse sectional view taken along the line 38—38 in FIG. 2B.
Figure 40:
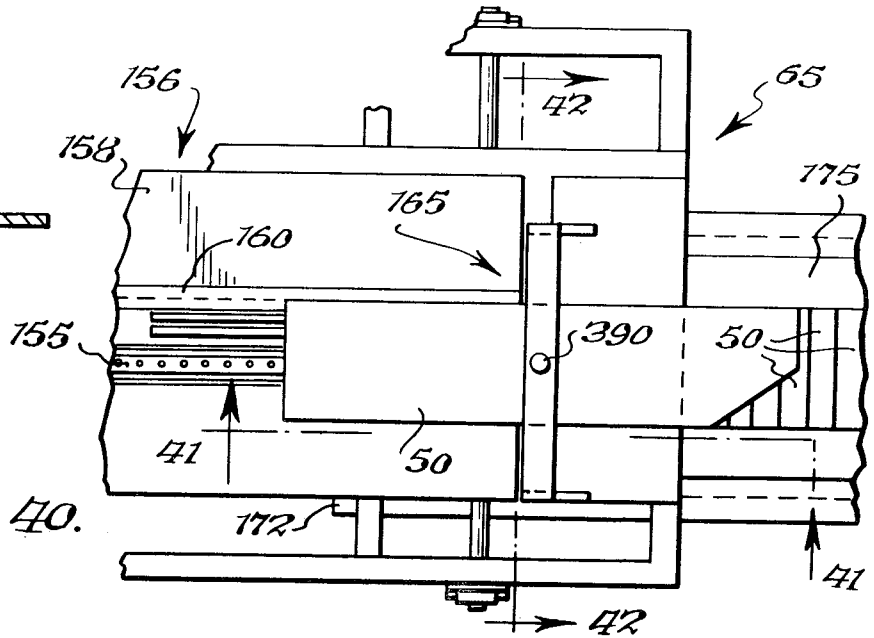
FIG. 40 is a fragmentary top plan view similar to a portion of FIG. 2C and showing one of the completed aprons as it continues its movement through the machine.

The folding station 142 includes a pair of plates 145 and 146 which are arranged to produce two lengthwise folds and thus reduce the width of the apron in the manner illustrated in FIG. 8. Each of these folds illustratively is of the order of five inches from the corresponding edge of the apron. As best shown in FIG. 38, the plates 145 and 146 operate under the control of pneumatic cylinders 148 and 149 having piston rods 150 and 151, respectively. The cylinders 148 and 149 are actuated simultaneously to pivot the plates 145 and 146 in an upward and inward direction about longitudinally extending hinges 152 and 153 to produce the folds. Upon the completion of the folds, the plates 145 and 146 are returned to their initial positions.

Figure 39:
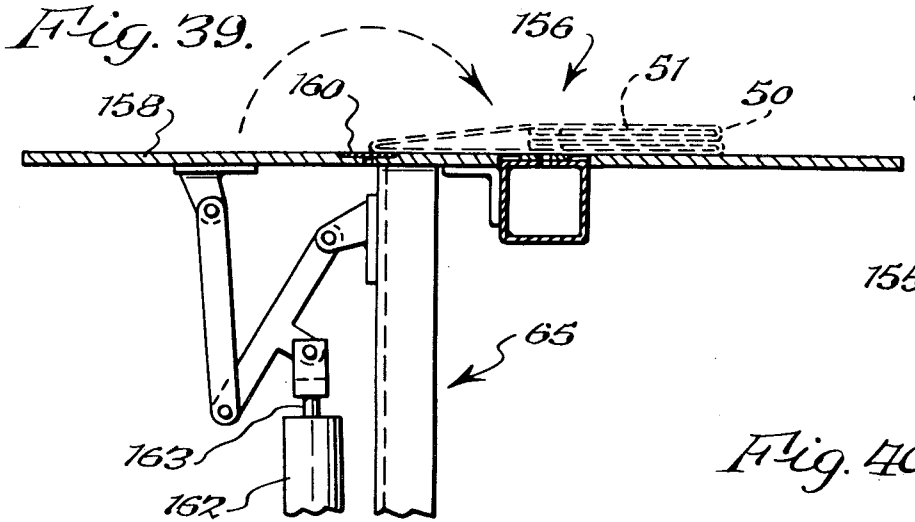
FIG. 39 is a fragmentary transverse sectional view taken along the line 39—39 in FIG. 2B.
Figure 42:
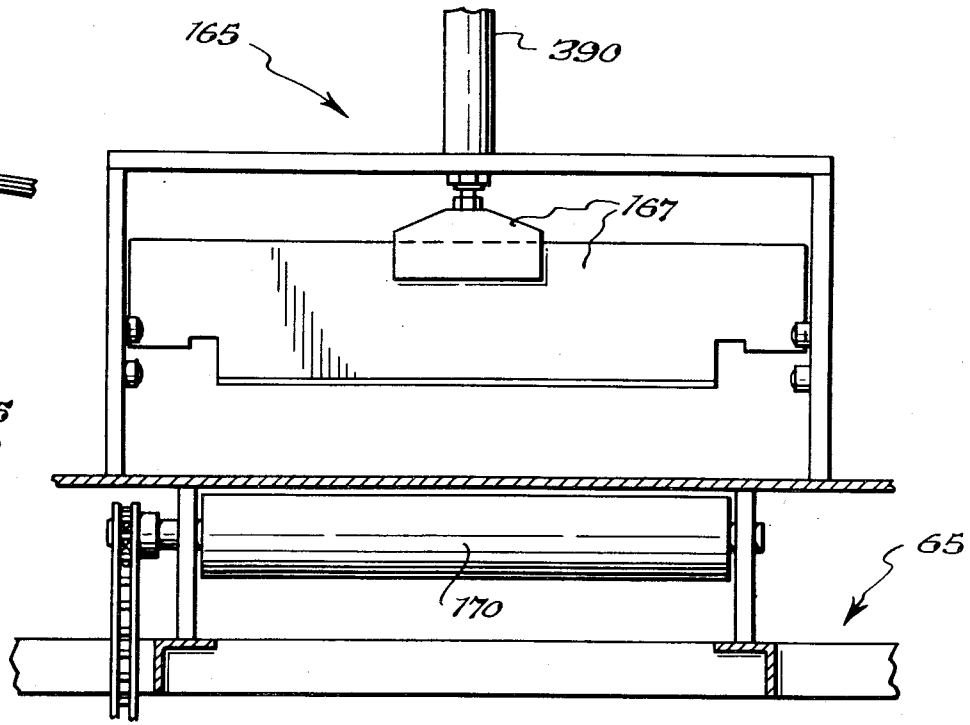
FIG. 42 is a fragmentary transverse sectional view taken along the line 42—42 in FIG. 40.

Thereafter, the vacuum belts 140 and 141 continue the advance of the apron 50 onto an additional vacuum belt 155 at a third folding station 156. A single folding plate 158 is disposed at this latter station and is connected to the supporting structure by a median longitudinal hinge 160. In response to the actuation of a pneumatic cylinder 162 (FIG. 39), a piston rod 163 within the cylinder moves the plate 158 about the hinge 160 into overlapping relationship with the apron 50. A longitudinal median fold is thus produced in the manner illustrated in FIG. 9.

Figure 1B:
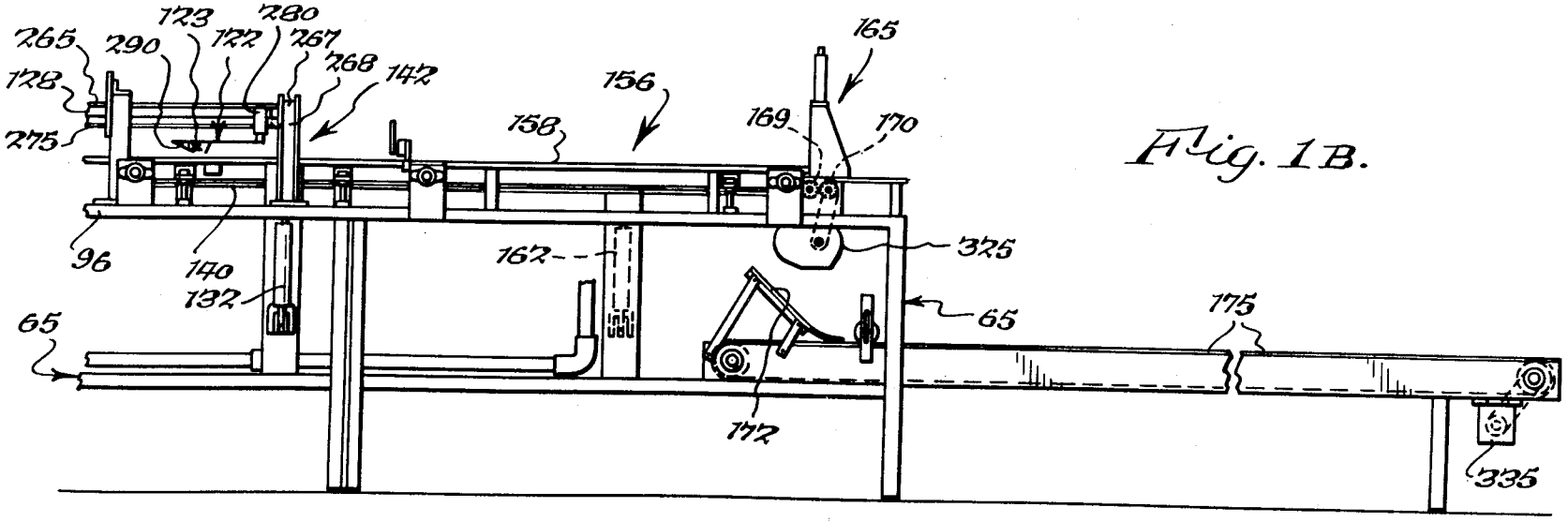
Figure 41:
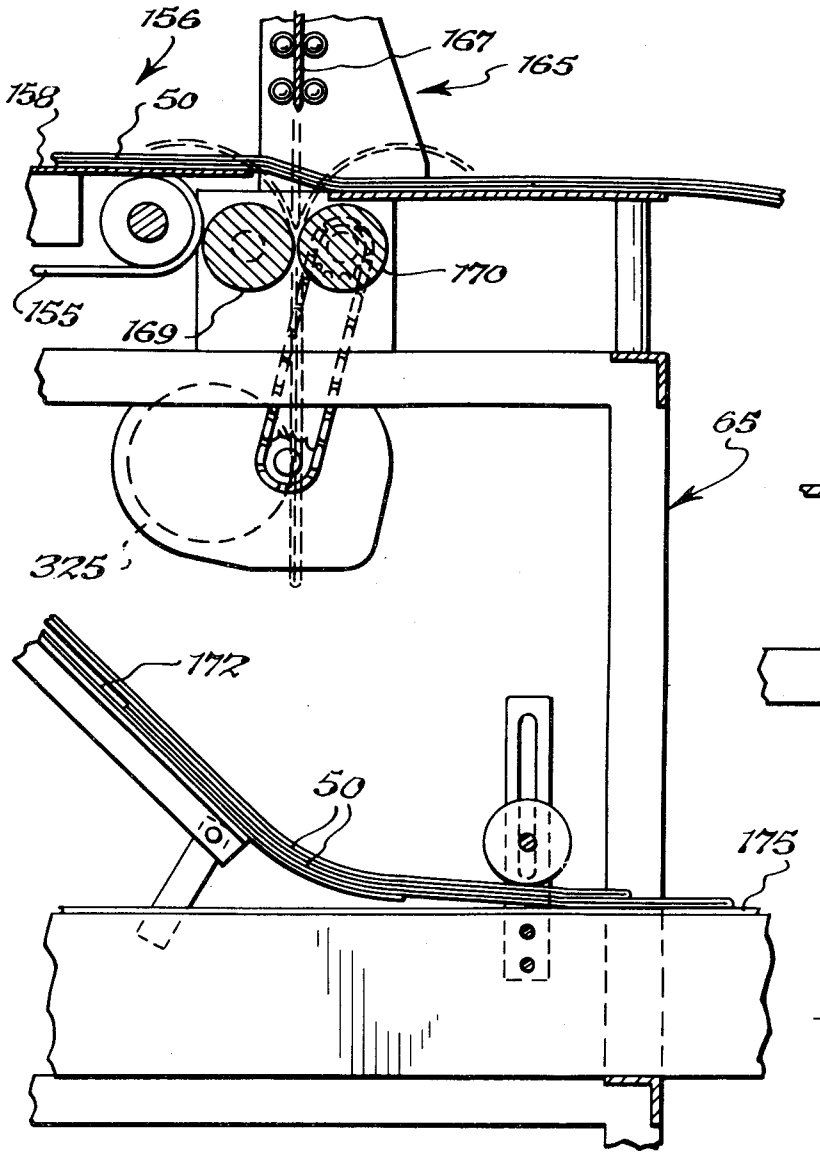
FIG. 41 is a longitudinal sectional view taken generally along the line 41—41 in FIG. 40.

Following the longitudinal folding of the apron 50, the folding plate 158 is returned to its initial position, and the vacuum belt 155 resumes the advance of the apron along its feed path to a guillotine folding station 165 (FIG. 1B). As best shown in FIG. 41, a vertically reciprocable folding plate 167 is located at the station 165 above the nip between two pinch rollers 169 and 170. As the apron 50 moves over the rollers 169 and 170, it is engaged by the plate 167 to tuck the apron between the rollers, thus producing a transverse median fold in the manner illustrated in FIG. 10. The completed and folded apron proceeds in a downward direction, as viewed in FIGS. 1B and 41, and is directed by an angularly disposed guide plate 172 onto an outfeed conveyor 175.

A more fully detailed description of particular components of the machine will now be set forth.

THE CUTTING MECHANISM

The cutting mechanism 90 is best shown in FIGS. 16–21. The mechanism includes a bottom plate 180 which rests on the machine frame 65 and extends in a transverse direction with respect to the feed path of the web. Two bearing blocks 182 and 183 are located on the plate 90 at opposite sides of the frame, and these blocks extend in an upward direction and support a top plate 184. The rollers 91 and 92 are journalled in the blocks 182 and 183 between the plates 180 and 184 with the peripheral surfaces of the rollers in spaced relationship with each other.

The rollers 91 and 92 are skewed in opposite directions relative to one another. Thus, in the illustrated embodiment the upper or knife roller 91 forms a clockwise angle of about one degree, as viewed in FIG. 16, with respect to the transverse dimension of the web, and the lower or anvil roller 92 forms a counterclockwise angle of about 1°, as viewed in this figure, with respect to the web's transverse dimension. The cutting blade 93 is located in a diagonal groove 185 in the roller 91 and is oriented at an angle, illustratively about 2°, with respect to the axis of the roller.

Figures 16, 17, 18, 19, 20, 21, 22:
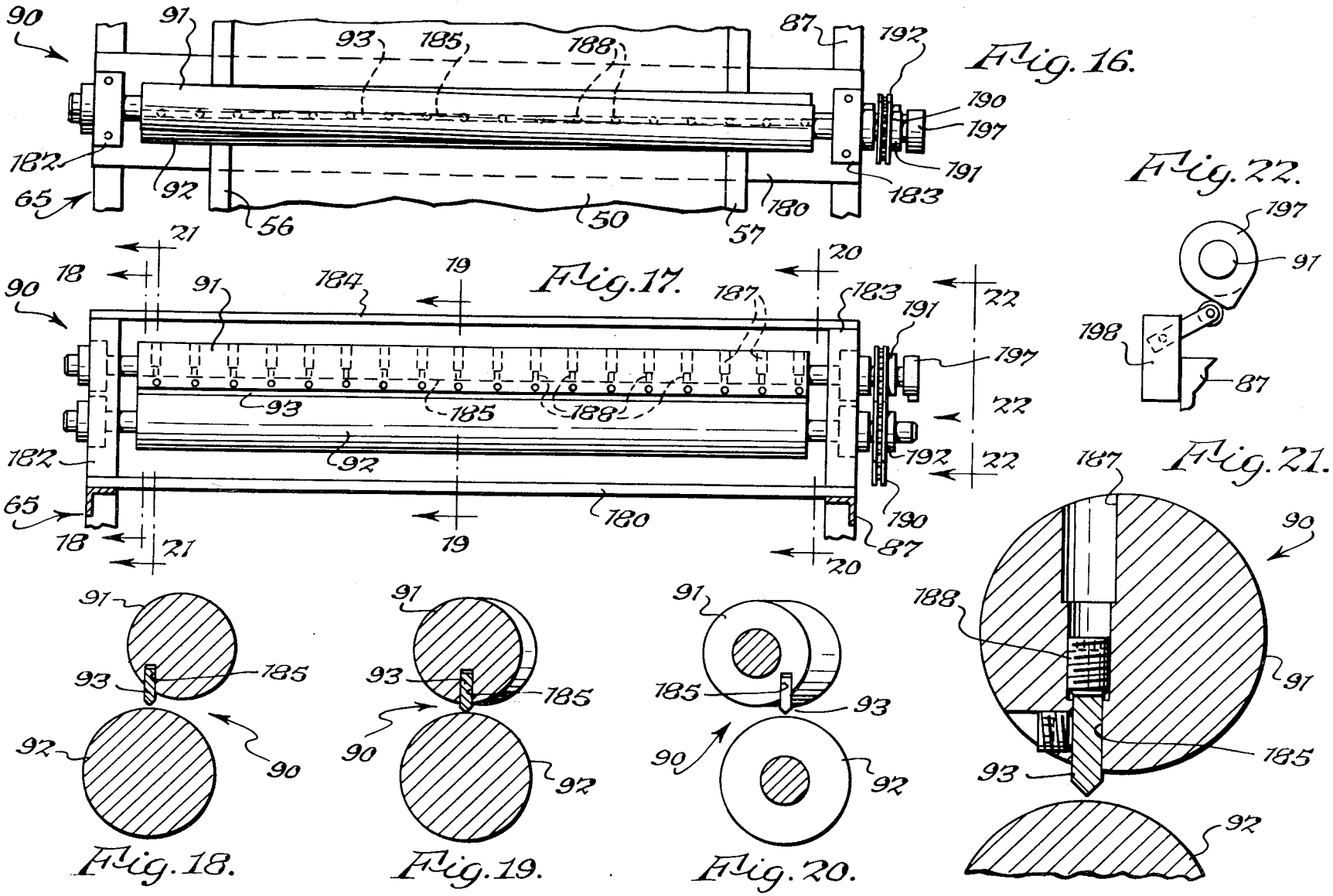
FIG. 16 is a top plan view of the web cutting mechanism for the machine.
FIG. 17 is a front elevational view of the cutting mechanism shown in FIG. 16.
FIGS. 18, 19 and 20 are enlarged fragmentary sectional views taken along the lines 18—18, 19—19 and 20—20, respectively, in FIG. 17.
FIG. 21 is a still further enlarged fragmentary sectional view taken along the line 21—21 in FIG. 17.
FIG. 22 is a fragmentary side elevational view of a portion of the cutting mechanism as seen from the line 22—22 in FIG. 17.

The knife roller 91 includes a series of spaced bores 187 along its length. As best shown in FIG. 21, each of the bores 187 communicates with the groove 185 and accommodates a set screw 188 in engagement with the blade 93. The set screws 188 are adjusted to position the blade 93 in precise relationship with the periphery of the anvil roller 92 and thus compensate for any unevenness of the blade.

The arrangement is such that the blade 93 contacts the anvil roller 92 at only a single point at any one time. This point moves across the web from one edge to the other as the rollers rotate, and the blade cuts the web along a straight line which extends in a direction transverse to the web's direction of movement along the feed path. The point contact between the blade 93 and the roller 92 provides a significant reduction in the loading of the cutting mechanism.

The cutting rollers 91 and 92 are driven by a chain 190. The chain 190 extends a sprocket 191 on the knife roller 91 and past a second sprocket 192 on the anvil roller 92. The chain then proceeds around a sprocket 193 (FIG. 1A) on the output shaft of a cutter motor 195.

Mounted on the knife roller 91 adjacent the drive sprocket 191 is a single lobe cam 197 (FIG. 22). A limit switch 198 cooperates with the cam 197 to shut off the motor 195, and hence bring the rollers 91 and 92 to rest, at the end of each revolution of the rollers. The operation of the motor is resumed to begin the next cycle in a manner that will become more fully apparent hereinafter in connection with the description of the electrical circuit for the machine.

THE STRIP FEEDING MECHANISM

A feeder table 200 (FIGS. 11 and 12) is disposed along one side of the machine frame immediately downstream of the cutting mechanism 90. The table 200 includes a magazine support plate 201 having two upstanding spindles 202 and 203. The spindle 202 rotatably supports the strip supply reel 106, while the spindle 203 supports a spare supply reel 205. The strip material from one or the other of the reels 106 or 205 passes between a pair of idler rollers 207 and 208 on the plate 201 and along the vertical face of a stationary guide plate 209. As the material moves from the idler rollers to the guide plate, it is interposed between a mirror 210 on one side of the material and a light source 211 and a photoelectric cell 212 on the opposite side. As will be described in more detail below, the photocell 212 is connected in the electrical circuit for the machine and functions to prevent operation of the strip advance motor in cases in which there is no strip material opposite the photocell.

Upon leaving the guide plate 209, the strip material enters the folding device 107 and moves past the adhesive unit 108 in the manner described heretofore. The folding device 107 and the adhesive unit 108 are supported on a horizontal mounting plate 215 affixed to the table 200. The plate 215 also carries the strip storage assembly 110 and the drive rollers 111 and 112. These rollers are driven by a chain 217 connected to a strip advance motor 220.

Two limit switches 222 and 223 are mounted on the frame for the table 200 above and below the dancer arm 115, and the dancer arm is pivotally supported by a pin 224 between these switches. The dancer arm 115 serves to take up slack in the strip material and thus performs a function similar to the web dancer arms described heretofore. When the arm 115 is in its lowermost position, as viewed in FIG. 11, indicating maximum storage of the material, the limit switch 223 is actuated to shut off the motor 220 and hence stop the advance of the strip toward the arm. As the arm 115 pivots in a clockwise direction as viewed in this figure about the pin 224 in response to the withdrawal of the strip, the motor 220 is actuated to resume the advance of the strip from its supply reel. Should the supply of material stored by the arm 115 become completely exhausted, the arm swings to its uppermost position to actuate the limit switch 222 and shut down the machine.

Upon leaving the dancer arm rollers 114 and the idler rollers 113, the strip material passes through a non-reversing device 225. As best shown in FIG. 13, the device 225 includes an idler roller 226 and a blade member 227 on opposite sides of the strip. The member 227 is pivotally supported by a horizontal pin 228 and is arranged to prevent the strip from moving in the reverse direction due to the weight of the dancer arm 115.

The capstan 116 is located adjacent the outfeed side of the table 200. A U-shaped bracket 230 is affixed to the table 200 and carries a capstan drive motor 231. The output shaft of the motor 231 is directly connected to the capstan 116 to provide an independent source of power for the strip material. The capstan engages a single side of the strip and applies additional driving force thereto as the strip changes direction and approaches the feed path of the sheets 51.

Figures 23, 24:
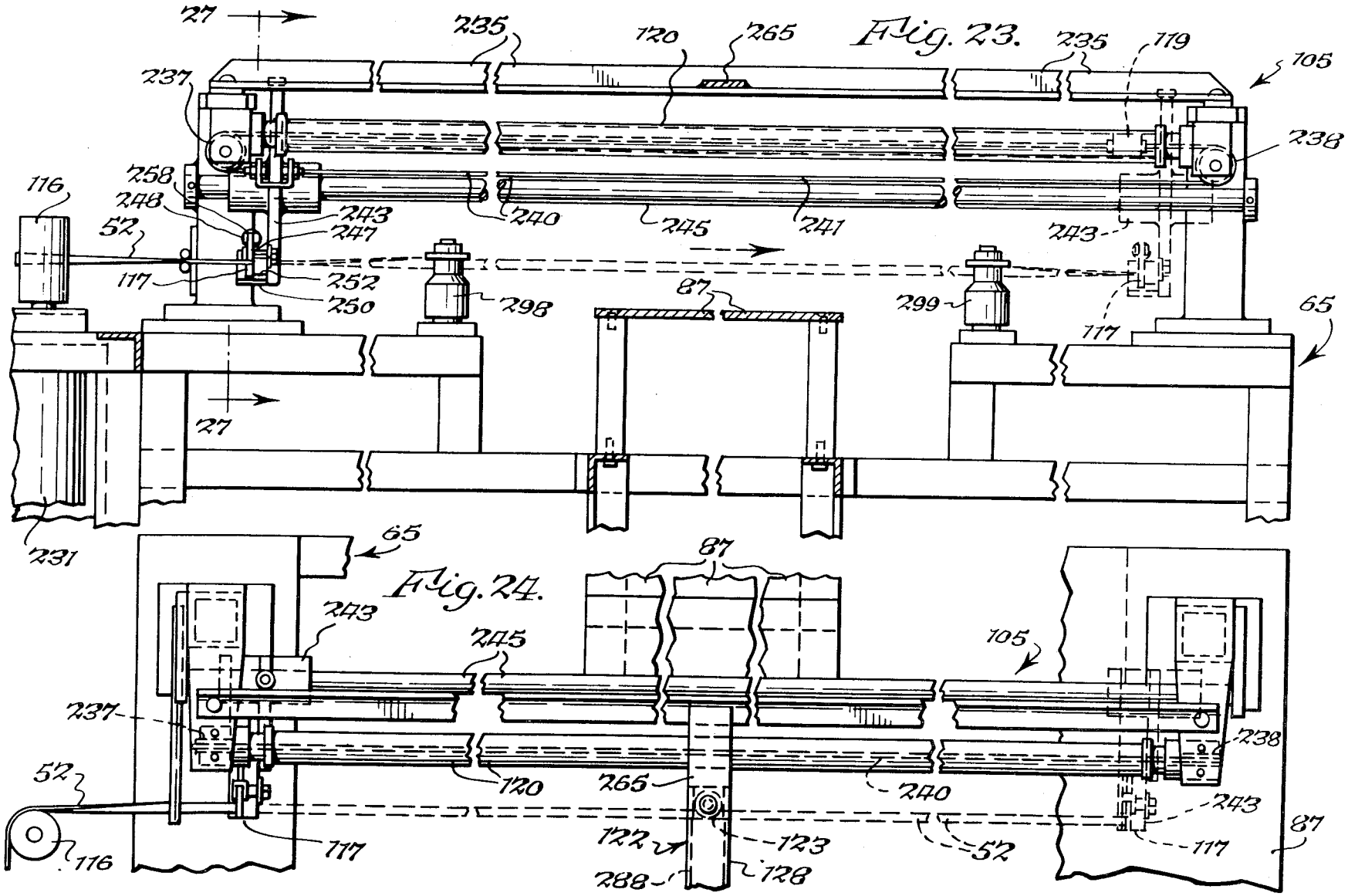
FIG. 23 is an enlarged transverse sectional view taken along the line 23—23 in FIG. 2B and illustrating the strip clamping mechanism of the machine in successive positions.
FIG. 24 is a fragmentary top plan view of the clamping mechanism shown in FIG. 23, together with a portion of the strip pull mechanism.

The remaining portion of the strip mechanism 105 is supported by the machine frame 65. As best shown in FIGS. 23 and 24, a mounting stand 235 extends across the machine above the table 87 and carries the pneumatic cable cylinder 120. This cylinder is provided with two pulleys 237 and 238 and a cooperating cable 240 attached to the piston 119. The lower reach 241 of the cable 240 extends externally beneath the cylinder 120 and is affixed to a slide member 243. The slide member 243 is arranged to move back and forth across the machine on a stationary guide rod 245 in response to movement of the piston 119. The piston is normally urged to the left from the position shown in FIG. 23 such that the slide member normally is maintained in its right-hand, dash line position at the side of the machine opposite that adjacent the capstan 116.

Figures 27, 28, 29, 30, 31, 32, 33, 34:
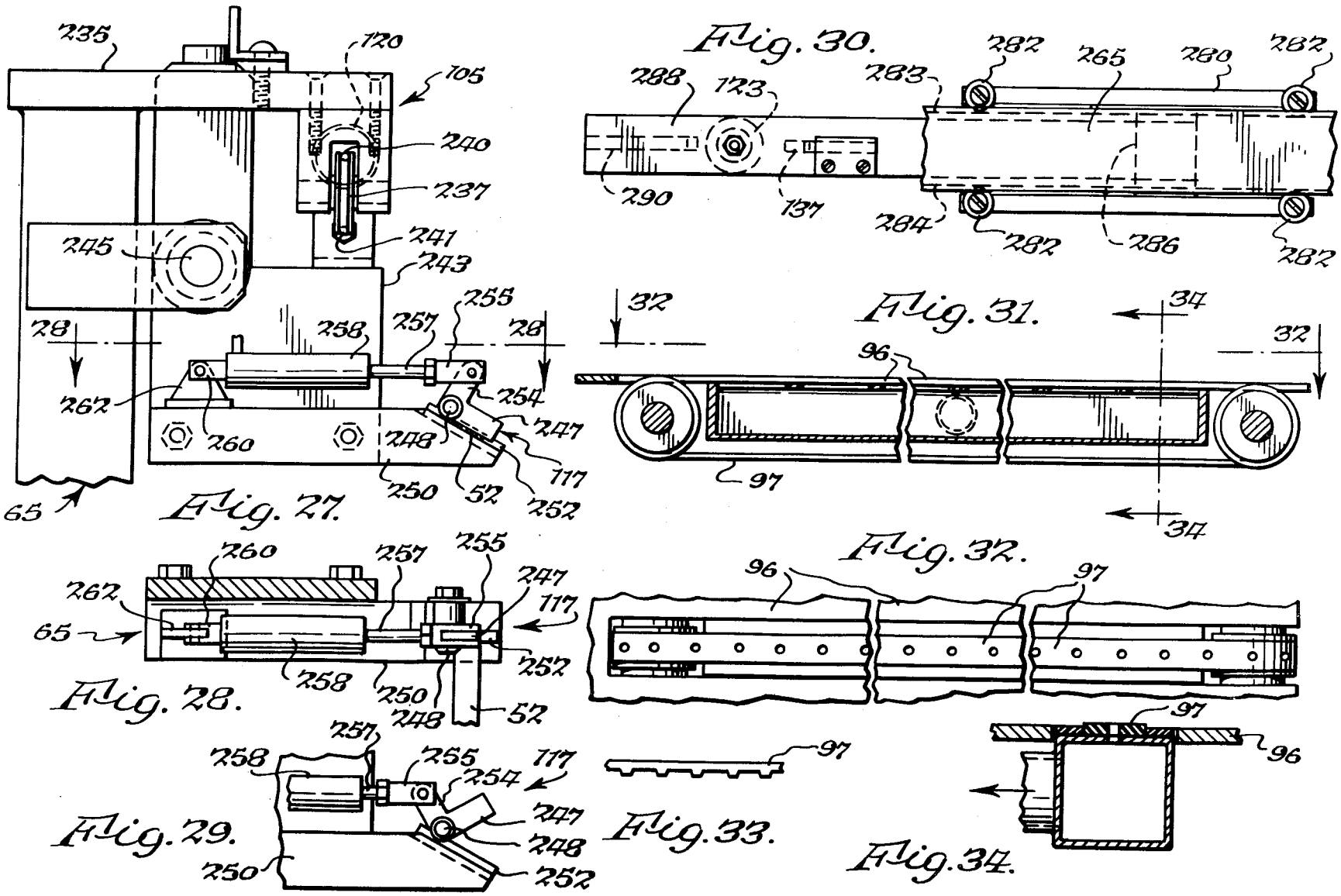
FIG. 27 is an enlarged fragmentary sectional view taken along the line 27—27 in FIG. 23.
FIG. 28 is a sectional view taken along the line 28—28 in FIG. 27.
FIG. 29 is a fragmentary sectional view similar to a portion of FIG. 27 but showing certain parts of the machine in a different position.
FIG. 30 is a fragmentary plan view of the pull mechanism as seen from the line 30—30 in FIG. 25.
FIG. 31 is a fragmentary longitudinal sectional view of one of the vacuum belts and associated parts for the machine.
FIG. 32 is a fragmentary longitudinal plan view as seen from the line 32—32 in FIG. 31.
FIG. 33 is an enlarged fragmentary side view of a segment of the vacuum belt shown in FIG. 31.
FIG. 34 is an enlarged transverse sectional view taken along the line 34—34 in FIG. 31.

The slide member 243 carries the clamping mechanism 117. As best illustrated in FIGS. 27–29, the mechanism 117 includes a cutter blade 247 which is pivotally supported by a horizontal pin 248. This pin is mounted adjacent the downstream end of a longitudinally extending body member 250 affixed to the lower portion of the slide member 243. The blade 247 cooperates with a shear blade 252 on the body member 250.

The cutter blade 247 includes an upstanding arm 254 pivotally connected to a clevis 255. The clevis 255 is mounted on a reciprocable piston rod 257 which protrudes from one end of a pneumatic cylinder 258. A second clevis 260 is attached to the opposite end of the cylinder and is pivotally supported by a bracket 262.

Upon the release of the pressure within the cylinder 258, the piston rod 257 moves to the right from the position shown in FIG. 29 to that shown in FIG. 27. The rod 257 pivots the cutter blade 247 in a clockwise direction, as viewed in these Figures, to thereby cut the strip 52. At the termination of this pivotal movement, the rod 257 holds the blade 247 firmly against the adjacent portion of the body member 250 to clamp the incoming portion of the strip material.

Thereafter, the pressure within the cable cylinder 120 is reversed to cause the piston 119 to move toward the capstan 116 and thereby urge the slide member 243, and hence the clamping mechanism 117, in the opposite direction to the position illustrated in dash lines in FIGS. 23 and 24. The clamping mechanism 117 draws the strip 52 from the capstan 116 across the feed path of the incoming sheet 51 and maintains the strip reasonable taut above the sheet. At a later point in the operation cycle, following the actuation of the triangular folding plates 130 and 131 (FIG. 2B) to adhesively secure the strip to the sheet, the pneumatic cylinder 258 returns the piston rod 257 to the position shown in FIG. 29 to release the strip. The piston 119 within the cable cylinder 120 is likewise returned to move the clamping mechanism 117 back across the machine to its position adjacent the capstan 116. The pressure within the cylinder 258 is again applied to sever the strip and to firmly clamp the free end of the strip material in preparation for the next cycle.

THE NECK PULL MECHANISM

Figures 25, 26:
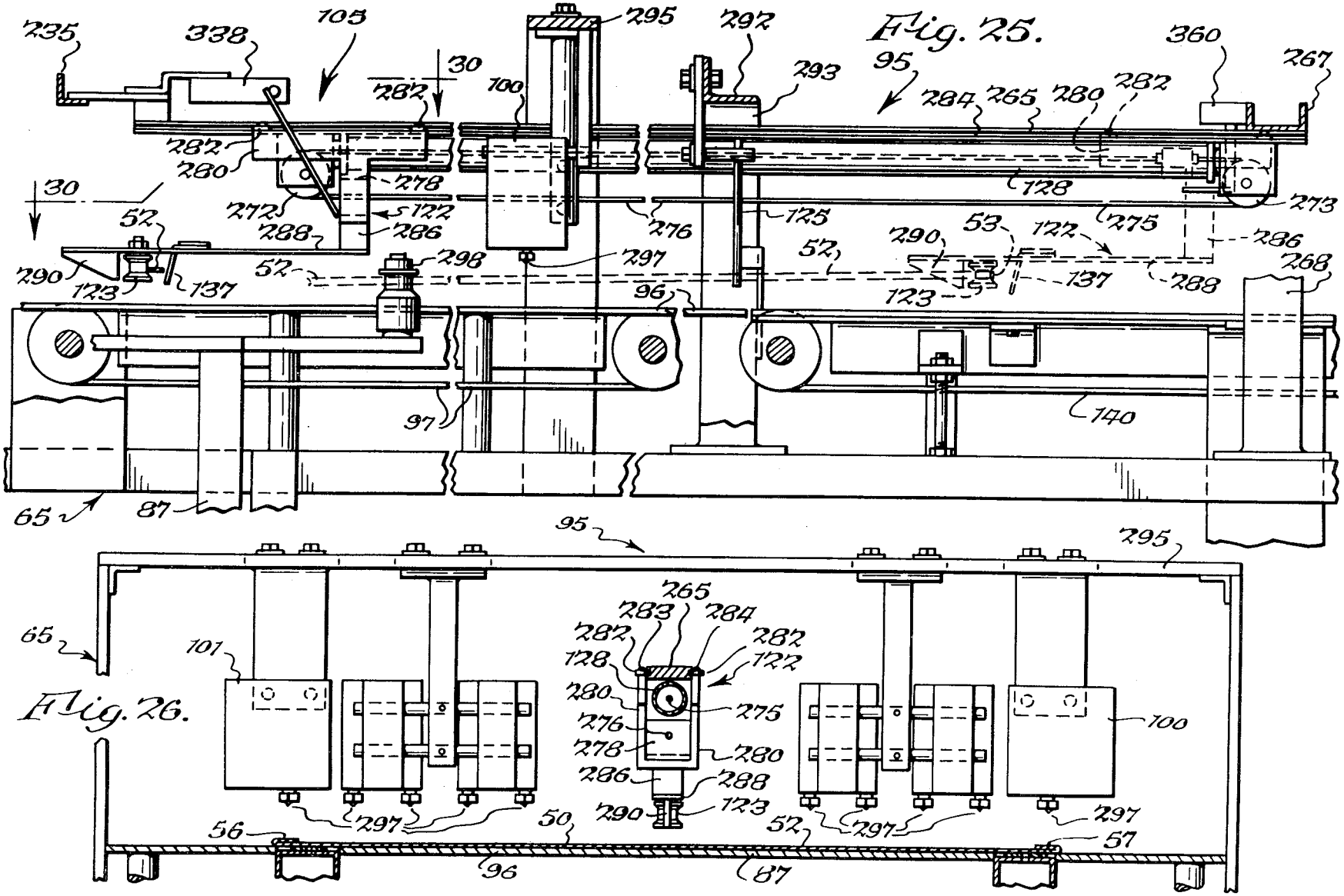
FIG. 25 is a longitudinal sectional view taken generally along the line 25—25 in FIG. 2B and showing the strip pull mechanism.
FIG. 26 is a transverse sectional view taken along the line 26—26 in FIG. 2B.

As best shown in FIG. 25, a stationary slide plate 265 is centrally located above the first folding station 95. The plate 265 is in the form of a longitudinally extending track with its upstream end supported by the mounting stand 235 for the strip mechanism 105 and its downstream end affixed to a support channel 267. The channel 267 extends across the machine and is carried by two upstanding posts 268 and 269 (FIG. 2B).

The cable cylinder 128 is suspended from the slide plate 265. Two pulleys 272 qand 273 are located adjacent the opposite ends of the cylinder 128 and are provided with a cable 275 affixed to a suitable piston within the cylinder. The lower reach 276 of the cable 275 is externally disposed with respect to the cylinder 128 and is connected to a bracket 278 (FIG. 26) mounted within a U-shaped trolley 280. The legs of the trolley 280 extend upwardly about the cylinder 128 and are provided at their upper ends with bearings 282. These bearings are slidably disposed in opposed longitudinal grooves 283 and 284 in the edges of the plate 265.

Affixed to the lower portion of the trolley 280, as by a spacer block 286, is an arm 288. The arm 288 extends in an upstream direction from the trolley 280 and carries the pull roller 123 for the neck loops 53 (FIG. 6). A generally triangular deflector element 290 is mounted on the arm 288 immediately upstream of the roller 123, and the depending finger 137 is supported by the arm a short distance downstream of the roller. The finger 137 preferably is flexible and illustratively may be made of nylon.

The stationary posts 125 and 126 (FIG. 35) are carried by an angle bracket 292. The bracket 292 extends across the machine and is affixed to upstanding support members 293 which are located between the support channel 267 and the mounting stand 235 for the strip mechanism. The adhesive units 100 and 101 are supported in similar fashion by a cross machine bracket 295 between the bracket 292 and the mounting stand 235. Each of the adhesive units 100 and 101 includes five nozzles 297, corresponding in number to the five beads of adhesive in the respective groups 102 and 103 (FIG. 6), and these nozzles are mounted in stationary positions a short distance above the incoming sheet 51.

With the strip 52 stretched across the machine between the roller 123 and the finger 137, the cable cylinder 128 is pressurized to move the trolley 280 in the downstream direction along the slide plate 265. The roller 123 contacts the central portion of the strip and carries it between the stationary posts 125 and 126 to the position illustrated by dash lines in FIG. 25, thus producing a V-shaped configuration to form the neck loop 53 (FIG. 6). During this downstream movement, the legs of the V engage two positioning rollers 298 and 299 (FIG. 2B) which are located adjacent opposite sides of the machine and serve to orient the legs in their proper positions.

At a subsequent point in the operation cycle, the pressure within the cable cylinder 128 is reversed to return the trolley 280, the hence the roller 123, the finger 137 and the deflector element 290, to their initial positions. As the finger 137 begins its return movement, it engages the neck loop 53 and moves the neck loop back over the apron from the position shown in FIG. 7 to that illustrated in FIG. 8. The neck loop is thus oriented within the outline of the apron to facilitate the ensuing folding and stacking operations. The trolley 280 continues its return movement, and as it approaches its initial position the element 290 deflects the strip 52 for a succeeding apron and moves the strip into position between the roller 123 and the finger 137 in preparation for the next cycle.

ELECTRICAL AND PNEUMATIC SYSTEMS

Figure 43:
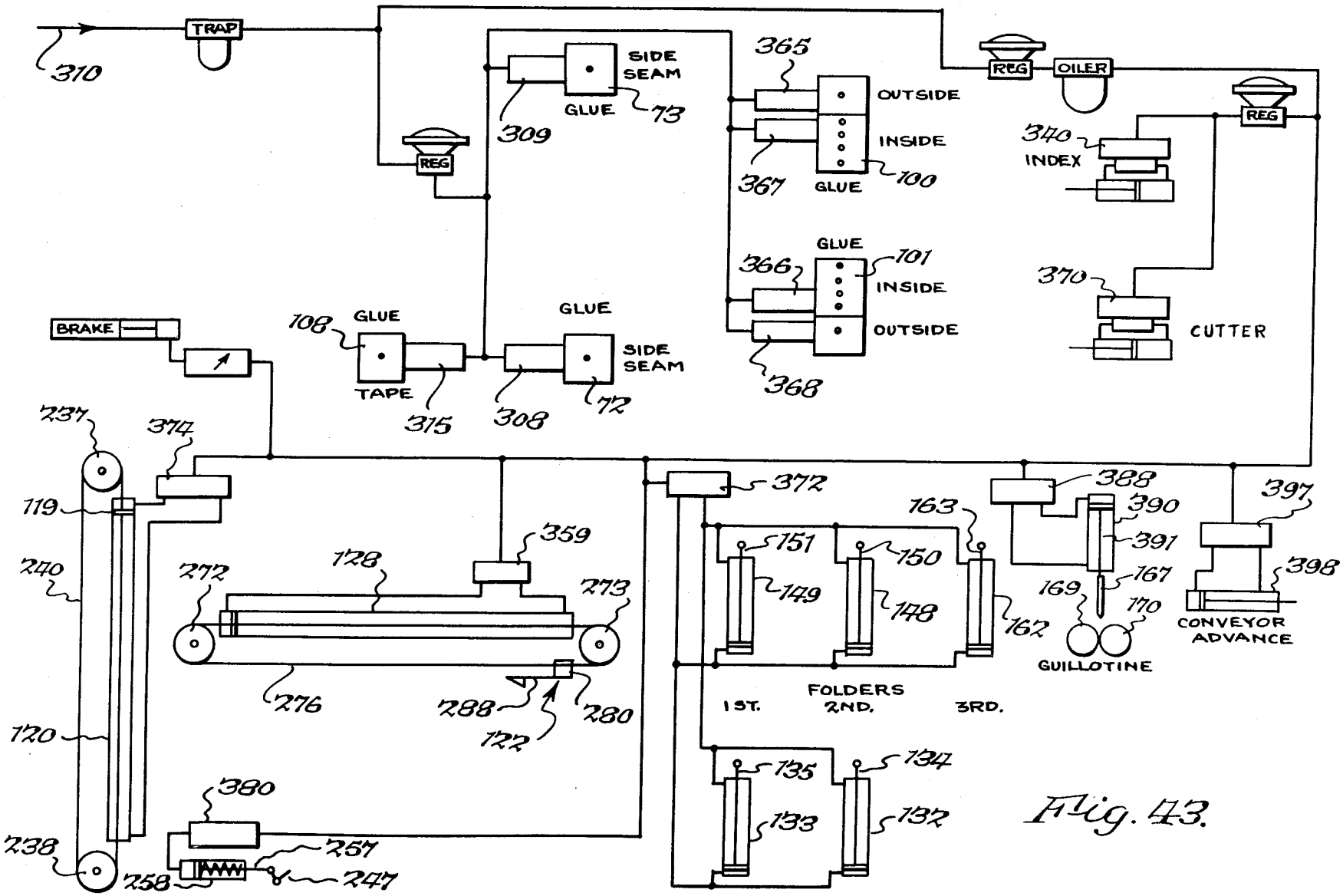
FIG. 43 is a schematic representation of the pneumatic system of the machine.
Figure 44A:
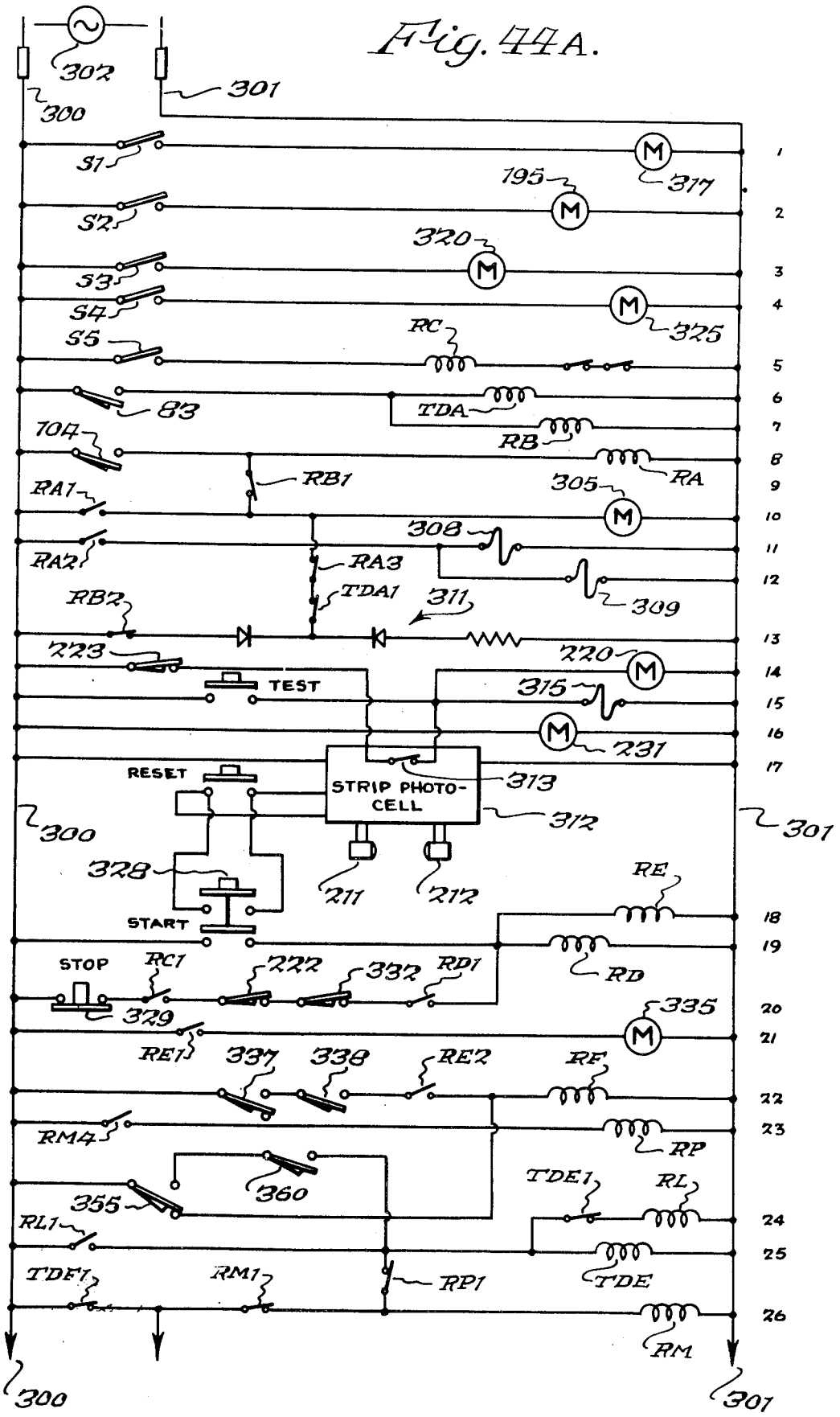
FIGS. 44A and 44B collectively comprise a schematic representation of the electrical system of the machine.
Figure 44B:
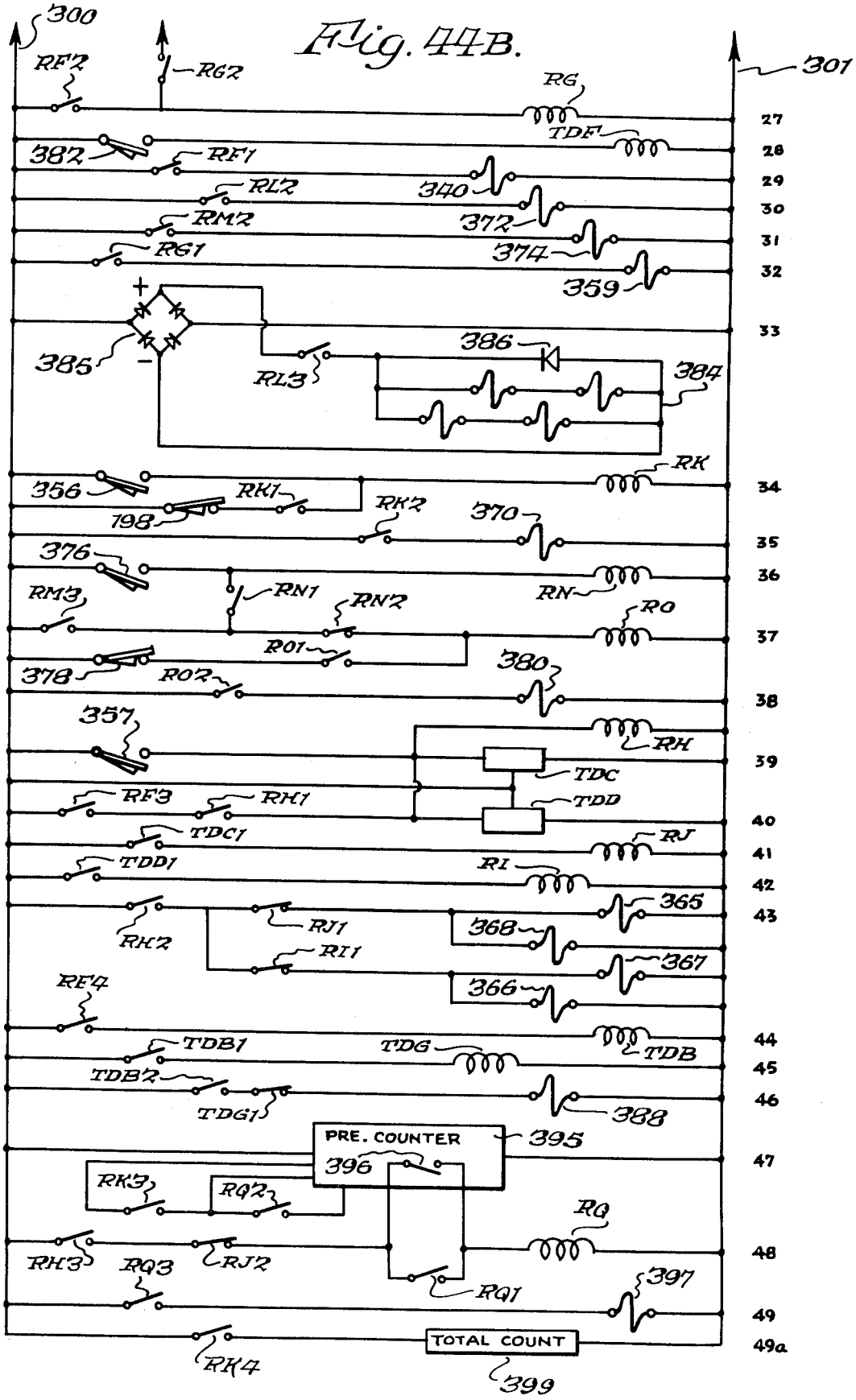

Referring to FIGS. 44A and 44B, the various electrical devices and circuits will now be described. To form the complete circuit diagram these figures should be placed end to end with their major length vertical. The individual circuits extend horizontally in FIGS. 44A and 44B, and to facilitate their identification each horizontal line has been numbered sequentially. Certain of these circuits control portions of the pneumatic system illustrated in FIG. 43 in a manner that will become more fully apparent hereinafter.

The electrical system includes two conductors 300 and 301 which are supplied with alternating current from a conventional AC source 302. The circuit for the side seaming portion of the machine, that is, the portion including the various components supported by the receiving table 62 (FIG. 1A), operates independently of the main machine under the control of the mercury switch 104 (line 9) and the limit switch 83 (line 7). To initiate the operation of the side seaming circuit, the dancer arm 81 is raised to a level sufficient to close the switch 104 and thereby energize a relay RA in series with the switch. This relay includes normally open contacts RA1 (line 10) and RA2 (line 11) and normally closed contacts RA3 (line 12). Upon energization of the relay, the contacts RA1 close to complete a latching circuit for the relay through normally closed contacts RB1 and also to apply power to a web advance motor 305. The motor 305 is located on the machine frame and is connected to the lower drive roller 64 by a chain 307. The drive rollers 63 and 64 are operated under the control of the motor 305 to draw a predetermined length of the web 60 along the table 62.

Energization of the relay RA also closes the contacts RA2 (line 11) to actuate two solenoid valves 308 and 309. As best shown in FIG. 43, these valves are connected to a manifold 310 and are arranged to activate the adhesive units 72 and 73. The units 72 and 73 apply adhesive to the longitudinal edges of the web 60 in the manner described heretofore.

During the advance of the web 60 by the drive rollers 63 and 64, the dancer arm 81 pivots in a downward direction, as viewed in FIG. 1A, until it reaches its lowermost position. In this position the arm 81 closes the limit switch 83. The closing of the switch 83 energizes a time delay relay TDA (line 7) and a second relay RB which are connected in parallel with each other and in series with the switch 83. The relay RB opens its normally closed contacts RB1 (between lines 9 and 10) to break the latching circuit for the relay RA, thus de-energizing the relay to open its contacts RA1 and RA2 and shut off the motor 305 and the adhesive solenoid valves 308 and 309. Energization of the relay RB also closes its normally open contacts RB2 (line 13) to actuate a dynamic braking circuit 311 for the motor 305. The relay TDA controls the length of time the braking circuit 311 is effective by opening the normally closed contacts TDA1 at the end of its timing cycle. The rotation of the drive rollers 63 and 64 is thus arrested to stop the advance of the web 60 until the dancer arm 81 again moves upwardly to close the mercury switch 104.

The circuit for the strip advance motor 220 (line 14) also operates independently of the main machine. This latter circuit includes the normally closed limit switches 222 and 223 adjacent the dancer arm 115 (FIG. 11). With the dancer arm 115 away from its uppermost position, the switch 222 (line 20) is closed to maintain a main machine circuit to be described subsequently. When the arm 115 is low, indicating a full supply of strip material, the switch 223 is actuated to break the circuit for the motor 220. However, as strip material is consumed by the machine the arm rises and upon reaching a predetermined point permits the switch 223 to close, thus connecting the motor 220 across the conductors 300 and 301 through a photocell circuit 312. The circuit 312 includes the light source 211, the photoelectric cell 212, and a switch 313 in series with the motor 220. As long as the strip material is present between the mirror 210 (FIG. 12) and the light source 221, the light is prevented from reaching the photocell 212, and the switch 313 is maintained in its closed position such that the closing of the switch 223 energizes the motor.

The motor 220 operates the drive rollers 111 and 112 (FIG. 11) to feed additional strip material from the supply reel 106 past the folding device 107 and the adhesive unit 108 to the dancer arm 115. As the limit switch 223 closes to start the motor 220, it also connects a solenoid valve 315 (line 15) across the conductors 300 and 301. The solenoid valve 315 is energized to activate the adhesive unit 108 which applies a bead of adhesive to the incoming strip material in the manner described heretofore.

The remaining portion of the electrical circuit shown in FIGS. 44A and 44B controls the operation of the main machine. In general, the machine has two periods: either it is indexing the sheet material into position or it is folding. The end of one period starts the other. A complete cycle begins with the index period followed by the fold period, and the cycles are automatically repeated provided there is no lack of material on the receiving table 62 (FIG. 1A) or on the strip feeder table 200 (FIG. 11).

The circuit includes a main disconnect switch having contacts S1, S2, S3, S4 and S5 (lines 1–4 and 6). Upon actuation of the switch, the contacts S1 close to energize a web drive motor 317, the contacts S2 close to energize the cutter drive motor 195, the contacts S3 close to energize a pump motor 320 and the contacts S4 close to energize a guillotine roller motor 325. The motors 195 and 317 are provided with suitable clutch-brake mechanisms of conventional construction and are not effective to perform their machine functions until the engagement of the clutches. Energization of the motor 320 operates a pump (not shown) to pressurize the fluid systems of the machine, while energization of the motor 325 drives the guillotine rollers 169 and 170 (FIG. 41). The closure of the contacts S5 energizes a relay RC (line 5). This relay includes normally open contacts RC1 which close upon the energization of the relay to partially complete a circuit path at line 20.

To initiate the operation of the main machine, a manually operable start switch 328 (line 19) is closed to connect a relay RD directly across the conductors 300 and 301. The relay RD is energized to close its normally open contacts RD1 (line 20) and complete a latching circuit for the relay winding through a normally closed stop switch 329, the closed relay contacts RC1, the limit switch 222 and a second limit switch 332. As indicated above the limit switch 222 is controlled by the strip mechanism dancer arm 115 (FIG. 11) and remains closed except when the dancer arm is in its uppermost position, indicating a complete absence of stored strip material. The limit switch 332 is supported by the receiving table 62 (FIG. 1A) and likewise remains closed except when the dancer arm 81 is in its uppermost position. The completion of the latching circuit for the relay RD bypasses the start switch 328 and maintains the relay in its energized condition.

Connected in parallel with the relay RD is a second relay RE (line 18). Upon actuation of the start swtich 328, the relay RE is energized and is maintained in its energized condition by the latching circuit for the relay RD. The relay RE includes normally open contacts RE1 (line 21 ) which close upon energization of the relay to actuate a conveyor motor 335. The motor 335 is supported at the downstream end of the machine and operates the outfeed conveyor 175 (FIGS. 1B and 2C). The arrangement is such that the conveyor is operated only when the machine is producing aprons, thus insuring that proper spacing of the aprons is maintained on the conveyor between successive runs.

The energization of the relay RE also closes its normally open contacts RE2 (line 22). These latter contacts are connected in series with two limit switches 337 and 338. The switch 337 is controlled by the triangular folding plates 130 and 131 (FIGS. 35 and 36) at the first folding station 95 and connects the conductor 300 to the limit switch 338 during the time foldng plates ae horizontally disposed in coplanar relationship with the table 96. The limit swtich 338 is carried by the mounting stand 235 (FIG. 25) and is engaged by the trolley 280 in its upstream position to close the switch when the neck pull mechanism 122 is in condition for the formation of a neck loop 53.

When these conditions are met, the closure of the relay contacts RE2 energized a relay RF (line 22). The relay RF closes its normally open contacts RF1 (FIG. 44B, line 29) to energize a solenoid 340. This solenoid actuates the clutch portion of the clutch brake mechanism for the web drive motor 317. The motor 317 operates two chains 343 and 344 (FIG. 1A) which are respectively connected to the lower drive roller 86 and to the upstream shaft for the vacuum belts 97 and 98. The vacuum belts 97 and 98 are connected through suitable chain boxes to the remaining vacuum belts on the machine such that the drive rollers 85 and 86 and all of the vacuum belts are driven in unison by the motor 317 to advance the sheet material along its feed path.

As best shown in FIGS. 14 and 15, a timing chain 348 is disposed around a sprocket 349 on the drive roller 86. The chain 348 is arranged for movement in a clockwise direction, as viewed in FIG. 14, between the sprocket 349 and an idler sprocket 350 suitably supported by the machine frame 65. The chain 348 includes an adjustable lobe 352 which cooperates with three limit switchs 355, 356 and 357 located at spaced positions around the path of the chain.

At the start of the indexing cycle, the timing lobe 352 is in engagement with the limit switch 355 to hold the switch in its uppermost position, as viewed at line 24 in FIG. 44A. As the roller 85 begins to rotate in response to the energization of the relay RF to advance the sheet material, the lobe 352 moves away from the switch 355, permitting the switch to close a latching circuit for the relay winding.

Energization of the relay RF also closes its normally open contacts RF2 (FIG. 44B, line 27) to energize a relay RG. This latter relay closes normally open contacts RG1 (line 32) to actuate a solenoid valve 359 and closes normally open contacts RG2 to complete a latching circuit for the relay. As best shown in FIG. 43, the solenoid valve 359 controls the neck loop cable cylinder 128 and upon energization admits air under pressure to the right end of the cylinder, as viewed in this FIG. The trolley 280 is thereupon driven in a downstream direction to move the strip between the stationary posts 125 and 126 (FIG. 35) and thus form the neck loop 53. As the trolley 280 completes its downstream movement, it closes a limit switch 360 (FIG. 44A, between lines 23 and 24) to condition the circuit for subsequent machine functions. Additional circuits are conditoned upon the energization of the relay RF by the closing of its contacts RF3 (FIG. 44B, line 40) and RF4 (line 44). The closing of these latter contacts initiates the timing cycle for a time delay TDB.

As the lobe 352 on the timing chain 348 continues its movement, it closes the limit switch 357 (line 39) to supply current to a relay RH and two time delay relays TDC and TDD. The relay RH closes its contacts RH1 (line 40) to complete a latching circuit for the relay through the now closed contacts RF3. The relay contacts RH2 (line 43) also close to energize four solenoid valves 365, 366, 367 and 368. As best shown in FIG. 43, the valves 365 and 368 control the single outer nozzles 297 (FIG. 26) in the respective adhesive units 100 and 101, while the solenoids 366 and 367 control the four inner nozzles in the respective units. The valves admit adhesive to the corresponding nozzles to form the groups of bond lines 102 and 103 on the incoming sheets.

When the time delay relay TDD completes its timing period, it closes normally open contacts TDD1 (line 42) to energize a relay RI. The relay RI opens its normally closed contacts RI1 to break the circuit for the solenoid valves 366 and 367 and thus terminate the flow of adhesive from the inner nozzles in the units 100 and 101. Shortly thereafter, the time delay relay TDC completes its period to open contacts TDC1 and energize a relay RJ. This latter relay in turn opens contacts RJ1 to break the circuit for the solenoid valves 365 and 368 and thereby shut off the outer nozzles.

To sever the incoming web 60 and form one of the sheets 51, the lobe 352 on the rotating timing chain 348 actuates the limit switch 356 (line 34). The switch 356 completes a circuit to energize a relay RK, and the relay is latched in its energized condition by the closing of its contacts RK1. It will be noted that the limit switch 198 is closed at this point because of the position of the cam 197 (FIG. 22). Contacts RK2 (line 35) of the relay RK also close to energize a solenoid 370. This solenoid engages the clutch portion of the clutch brake mechanism for the cutter member 195 to drive the cutting rollers 91 and 92 through a single complete revolution and sever the incoming web. Upon the completion of its revolution, the cam 197 opens the limit switch 198 to de-energize the relay RK. The contacts RK2 there upon open to break the circuit for the solenoid 370 and shut down the cutting mechanism.

As the timing chain 348 completes its cycle, it actuates the limit switch 355 (line 24) to break the circuit for the relay RF and to complete a circuit through the limit switch 360, which at this point is being held closed by the neck pull mechanism, to a time delay relay TDE. The relay RF is de-energized to arrest operation of the web drive motor 317 and terminate the indexing cycle.

Connected in parallel with the time delay relay TDE is a series circuit comprising the normally closed contacts TDE1 and a second relay RL. This latter relay is energized simultaneously with the relay TDE at the completion of the indexing cycle to close its normally open contacts RL1 and RL2 (line 30). The contacts RL1 complete a latching circuit for the relays RL and TDE, while the contacts RL2 energize a folder solenoid valve 372 and thereby admit manifold pressure to the pneumatic cylinders 132, 133, 148, 149 and 162 (FIG. 43). The pistons within these cylinders thereupon simultaneously actuate the folding plates at the first, second and third folding stations to produce the longitudinal folds in the aprons in the manner described heretofore.

During the folding of the aprons, they are held in place by suitable clamping devices controlled by a DC solenoid circuit 384 (between lines 33 and 34). The circuit is connected to the conductive 300 and 301 through a bridge type rectifier 385, the normally open relay contacts RL3 and a contact protection diode 386. Upon the energization of the relay RL to actuate the folding plates, the contacts RL3 close to hold the aprons in position.

The operation of the timing chain limit switch 355 at the completion of the indexing cycle also energizes a relay RM (line 26) through a circuit including the now closed limit switch 360 and the normally closed relay contacts RP1. The relay RM closes its normally open contacts RM1, thus completing a latching circuit for the relay through the normally closed contacts TDF1, closes its normally open contacts RM2 (line 31) to energize a solenoid valve 374 and closes its normally open contacts RM3 (line 37). Upon the closing of these latter contacts, a circuit is completed through the normally closed relay contacts RM2 to a relay RO. The relay R0 is energized to close its normally open contacts RO1 and RO2 (line38). The contacts RO1 complete a latching circuit for the relay RO through a closed limit switch 378, while the contacts RO2 energize a solenoid valve 380. The valve 380 actuates the clamping mechanism cylinder 258 (FIG. 43) to release the strip. Energization of the solenoid valve 374 operates the cable cylinder 120 to move the clamping mechanism across the machine to the strip pick-up position.

The energization of the relay RM also closes its normally open contacts RM4 (line 23) to energize a relay RP. The normally closed relay contacts PP1 (between lines 25 and 26) thereupon open, but the relay RM remains energized because of the latching circuit through the contacts TDF1 and RM1. With the folding plates in their up or folding positions, the limit switch 337 connects the line 300 to the relay RP to maintain the relay in an energized condition.

As the strip clamping mechanism moves toward the pick-up position, it first actuates a limit switch 376 (line 36) to energize a relay RN. The relay Rn closes its normally open contacts RN1 to complete a latching circuit through the now closed contacts RM3 and opens its normally closed contacts RN2, thus isolating the relay RO from the contacts RM3. When the clamping mechanism reaches the pick-up position, it operates an additional limit switch 378 (between lines 37 and 38). The switch 378 opens to break the latching circuit for the relay RO, thus de-energizing the relay and the solenoid valve 380 (line 38) to close the clamping mechanism and grip the strip.

The movement of the clamping mechanism to its pick-up position also closes a limit switch 382 (line 28). This switch energizes a time delay TDF. After a comparatively short time interval, the normally closed contacts TDF1 (line 26) of the relay TDF open to disconnect the latching circuit for the relays RM and RG (line 27). The relay RM de-energizes to break the circuit for the solenoid valve 374 (line 31) and cause the cylinder 120 to advance the strip mechanism across the machine with additional strip material, while the relay RG de-energizes to break the circuit for the solenoid valve 359 (line 32) and thus permit the neck pull mechanism to return to its upstream position.

The capstan motor 231 (line 16) is connected across the conductors 300 and 301 and rotates the capstan 116 in a clockwise direction, as viewed in FIG. 12. The capstan frictionally engages the strip to materially assist the strip mechanism in advancing the strip across the machine. Following the return of the strip and neck pull mechanisms, the relay TDE times out to open its contacts TDE1 (line 24) and de-energize the relay RL. The contacts RL1 (line 25) and RL2 (line 30) thereupon open, de-energizing the solenoid valve 372 and returning the various folding plates to their open positions.

The relay TDB (line 44) completes its timing cycle during the indexing period to close normally open contacts TDB1 (line 45) and TDB2 (line 46). The closing of the contacts TDB1 energizes a time delay relay TDG, and the closing of the contacts TDB2 energizes a solenoid valve 388 through the normally closed contacts TDG1 of the relay TDG. The solenoid valve 388 controls a pneumatic cylinder 390 (FIG. 43) having a piston rod 391 connected to the guillotine plate 167. The piston rod 391 moves the plate 167 downwardly to direct the apron between the pinch rollers 169 and 170 and produce a transverse median fold in the manner described above. The relay TDG then complete its timing cycle to open the contacts TDG1 and de-energize the solenoid valve 388, thus returning the plate 167 to its initial, raised position.

To facilitate the packaging of groups of aprons in successive containers, it is sometimes desirable to provide a space between each group on the outfeed conveyor 175. For this purpose the circuit includes a predetermine counter 395 (line 47). The counter 395 is connected across the conductors 300 and 301 and is arranged to close a switch 396 in response to a preset number of closings of the relay contacts RK3. These relay contacts are closed each time the relay RK (line 34) is energized in response to the operation of the cutting mechanism. When the preset number has been reached, the switch 396 closes to energize a relay RQ (line 48) through a circuit including the switch and the relay contacts RH3 and RJ2. The contacts RJ2 are normally closed, while the contacts RH3 are normally open but are closed upon each energization of the relay RH to initiate the application of adhesive to the incoming sheet. The relay RQ includes normally open contacts RQ1 which close upon energization of the relay to bypass the switch 396 and complete a latching circuit. The relay contacts RQ2 likewise close to reset the counter 395, and the contacts RQ3 (line 49) close to energize a solenoid valve 397. The valve 397 controls a pneumatic cylinder 398 (FIG. 43) which overrides the outfeed conveyor drive and advances the conveyor an extra space. The valve 397 is de-energized upon the de-energization of the relay RQ in response to the opening of the relay contacts RJ2 at the termination of the adhesive applying period, thus returning the conveyor to the control of the drive motor 335. With this arrangement, an extra space is provided on the outfeed conveyor between each preset number of aprons.

A second counter 399 (line 49*a*) is connected across the conductors 300 and 301 in series with the relay contacts RK4. The contacts RK4 close during each cycle in response to the energization of the cutting mechanism relay RK (line 34). The counter 399 thus registers a count of the total number of aprons produced by the machine.

It will of course be apparent that the specific circuitry and machine components which have been described are but illustrative, and numerous modifications may be made within the spirit of the invention. In many instances, for example, certain of the switching functions may be performed by electrical or mechanical timers rather than by the various limit switches illustrated in the drawings. Also, one or more additional suction belts may be employed particularly at the first folding station, and the sequence of operation may be changed in accordance with the particular garment being made. Other modifications will suggest themselves to those skilled in the art upon a perusal of the present disclosure.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. In a machine for handling sheet material in combination:

a source of flexiable sheet material;

means for receiving a web of material from said source and directing the same along a feed path;

a cutting mechanism positioned along the feed path for dividing the web into successive sheets, the cutting mechanism having a pair of rollers and cutting means carried by only one of the rollers, the rollers being skewed relative to each other and being angularly disposed with respect to a direction transverse to the direction of movement of the web along said feed path to provide point contact between the cutting means and the other roller, the cutting means being angularly disposed with respect to said transverse direction, being parallel to the axis of rotation of said other roller and severing the web along a straight line which extends in a direction transverse to said direction of movement; and drive means for advancing the web between said rollers.

2. In a machine as defined in claim 1, the receiving means including web storage means along the feed path on the upstream side of the cutting mechanism for taking up slack in the sheet material.

3. In a machine as defined in claim 1, in which the drive means is located upstream of the cutting mechanism.

4. In a machine for handling sheet material in combination:

a source of sheet material;

means for receiving a web of material from said source and directing the same along a feed path;

a cutting mechanism positioned along the feed path for dividing the web into successive sheets, the cutting mechanism having a pair of rollers and a cutting blade carried by only one of the rollers for cutting the web along a straight line which extends in a direction transverse to the web's direction of movement along the feed path, the cutting blade being adjustably positioned independent of said one roller with respect to said other roller, the rollers being skewed relative to each other and to said transverse direction to provide point contact between the blade and the other roller, and said cutting blade being angularly disposed with respect to said transverse direction and being parallel to the axis of rotation of said other roller; and drive means located along the feed path for intermittently advancing the web between said rollers.

5. In a machine for handling sheet material in combination:

a source of sheet material;

means for receiving a web of material from said source and directing the same along a feed path;

a cutting mechanism positioned along the feed path for dividing the web into successive rectangular sheets, the cutting mechanism having a pair of rollers and a cutting blade carried by only one of the rollers, said one roller being skewed in one direction with respect to a direction transverse to the direction of movement of the web along the feed path and said blade and the axis of the other roller being parallel to each other and being skewed in the opposite direction with respect to the web's transverse direction, to provide point contact between the blade and said other roller, the blade cutting the web along a straight line which extends in said direction transverse to said direction of movement; and drive means located along the feed path for intermittently advancing the web between said rollers.

6. In a machine as defined in claim 5, which further comprises:

means disposed at intervals along said one roller for adjusting the position of the cutting blade relative to said other roll.

7. In a machine for handling sheet material in combination:

a source of flexible sheet material;

means for receiving a web of material from said source and directing the same along a feed path, the receiving means including first drive means including a first pair of rollers for advancing the web along its path;

a cutting mechanism positioned along the feed path for dividing the web into successive sheets, the cutting mechanism having a second pair of rollers and cutting means carried by only one of the rollers in the second pair for severing the web along a straight line which extends in a direction transverse to the web's direction of movement along the feed path, said second pair of rollers each being skewed with respect to said transverse direction and to each other, and said cutting means being angularly disposed with respect to said transverse direction and being parallel to the axis of rotation of said other roller; and second drive means interposed between the first drive means and the cutting mechanism for intermittently advancing the web thereto.

* * * * *

UNITED STATES PATENT AND TRADEMARK OFFICE

CERTIFICATE OF CORRECTION

PATENT NO. : 4,044,641

DATED : August 30, 1977

INVENTOR(S) : George A. Burt, Jr. & William M. Neill

It is certified that error appears in the above-identified patent and that said Letters Patent are hereby corrected as shown below:

Col. 1, line 17, change "high" to -- highly --.

Col. 2, line 29, change "fed" to -- feed --.

Col. 2, line 34, change "V" to -- "V" --.

Col. 2, line 36, change "V" to -- "V" --.

Col. 2, line 54, change "wab" to -- web --.

Col. 6, line 68, change "V" to -- "V" --.

Col. 7, line 12, change "V" to -- "V" --.

Col. 11, line 65, change "V" to -- "V" --.

Col. 13, line 27, change "221" to -- 211 --.

Col. 14, line 20, change "swtich" to -- switch --.

Col. 14, line 39, change "foldng" to -- folding --.

UNITED STATES PATENT AND TRADEMARK OFFICE

CERTIFICATE OF CORRECTION

PATENT NO. : 4,044,641

DATED : August 30, 1977

INVENTOR(S) : George A. Burt, Jr. & William M. Neill

It is certified that error appears in the above-identified patent and that said Letters Patent are hereby corrected as shown below:

Col. 14, line 39, change "ae" to -- are --.

Col. 14, line 41, change "swtich" to -- switch --.

Col. 15, line 65, change "member" to -- motor --.

Col. 16, line 58, change "PP 1" to -- RP 1 --.

Col. 16, line 67, change "Rn" to -- RN --.

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*